US008141731B2

(12) United States Patent
Mazurkiewicz et al.

(10) Patent No.: US 8,141,731 B2
(45) Date of Patent: Mar. 27, 2012

(54) CLOSURE WITH LID AND SLIDABLE LATCH SYSTEM

(75) Inventors: Timothy M. Mazurkiewicz, Waukesha, WI (US); John Wisniewski, Wauwatosa, WI (US)

(73) Assignee: Seaquist Closures L.L.C., Mukwonago, WI (US)

( * ) Notice: Subject to any disclaimer, the term of this patent is extended or adjusted under 35 U.S.C. 154(b) by 496 days.

(21) Appl. No.: 12/154,748

(22) Filed: May 27, 2008

(65) Prior Publication Data

US 2009/0294447 A1 Dec. 3, 2009

(51) Int. Cl.
*B65D 43/16* (2006.01)
*B65D 43/22* (2006.01)
*B65D 43/26* (2006.01)

(52) U.S. Cl. ..... 215/237; 215/245; 220/254.3; 220/283; 220/326

(58) Field of Classification Search ..... 215/237, 215/245, 235; 220/326, 283, 254.3
See application file for complete search history.

(56) References Cited

U.S. PATENT DOCUMENTS

| | | | | |
|---|---|---|---|---|
| 3,850,350 | A | 11/1974 | Towns et al. | |
| 4,010,875 | A | 3/1977 | Babiol | |
| 4,625,898 | A | 12/1986 | Hazard | |
| 4,901,882 | A * | 2/1990 | Goncalves | 220/324 |
| 5,131,558 | A * | 7/1992 | Hiromori | 220/326 |
| 5,193,707 | A | 3/1993 | Mizumura | |
| 5,390,828 | A | 2/1995 | Gross | |
| 5,460,288 | A * | 10/1995 | Balzeau | 220/326 |
| 5,573,127 | A | 11/1996 | Takahashi | |
| 5,752,612 | A | 5/1998 | Fritzsche et al. | |
| 5,868,265 | A | 2/1999 | Kobayashi | |
| 5,873,476 | A | 2/1999 | Takahashi et al. | |
| 6,732,873 | B2 | 5/2004 | Bried et al. | |
| 6,742,666 | B1 | 6/2004 | Bried et al. | |

(Continued)

FOREIGN PATENT DOCUMENTS

| | | |
|---|---|---|
| JP | 59-148708 | 10/1984 |

(Continued)

OTHER PUBLICATIONS

"International Search Report and The Written Opinion of the International Searching Authority, or The Declaration" with a completion date of May 27, 2009 and a date of mailing of Jul. 2, 2009 for PCT/US2009/02324.

(Continued)

*Primary Examiner* — Anthony Stashick
*Assistant Examiner* — Niki M Eloshway
(74) *Attorney, Agent, or Firm* — Wood, Phillips, Katz, Clark & Mortimer

(57) ABSTRACT

The present dispensing closure system includes a closure base, which can be configured for securement to an associated container, and a lid hingedly connected to the closure base for movement between closed and open positions, wherein in the closed position of the lid, the lid coacts to close and seal a dispensing orifice defined by the closure base. Convenient manipulation of the lid between its closed and open positions is facilitated by the provision of a sliding element mounted on the closure base for sliding, reciprocable movement generally laterally of the closure base. Notably, the sliding element includes a latch portion which coacts with the lid to positively retain the lid in its closed position until manipulation of the sliding element by a user to unlatch the lid. The sliding element includes one or more camming surfaces which coact with the lid to urge it from its closed position to its open position.

12 Claims, 21 Drawing Sheets

U.S. PATENT DOCUMENTS

| | | | | |
|---|---|---|---|---|
| 6,834,769 | B2 | 12/2004 | Takahashi | |
| 6,908,017 | B2 | 6/2005 | Mineau et al. | |
| 7,000,792 | B2 | 2/2006 | Arai | |
| 7,278,554 | B2 | 10/2007 | Armstrong | |
| 7,611,024 | B2 * | 11/2009 | Yamanaka et al. | 215/237 |
| 2005/0023285 | A1 | 2/2005 | Keung | |
| 2005/0061014 | A1 | 3/2005 | Cannan | |
| 2007/0175909 | A1 | 8/2007 | Solowiejko | |

FOREIGN PATENT DOCUMENTS

| | | |
|---|---|---|
| JP | 6-15844 | 4/1994 |
| JP | 6-76094 | 10/1994 |
| JP | 7-9747 | 2/1995 |

OTHER PUBLICATIONS

U.S. Appl. No. 12/459,750, filed Jul. 7, 2009 by Peter J. Walters et al.

* cited by examiner

FIG. 8
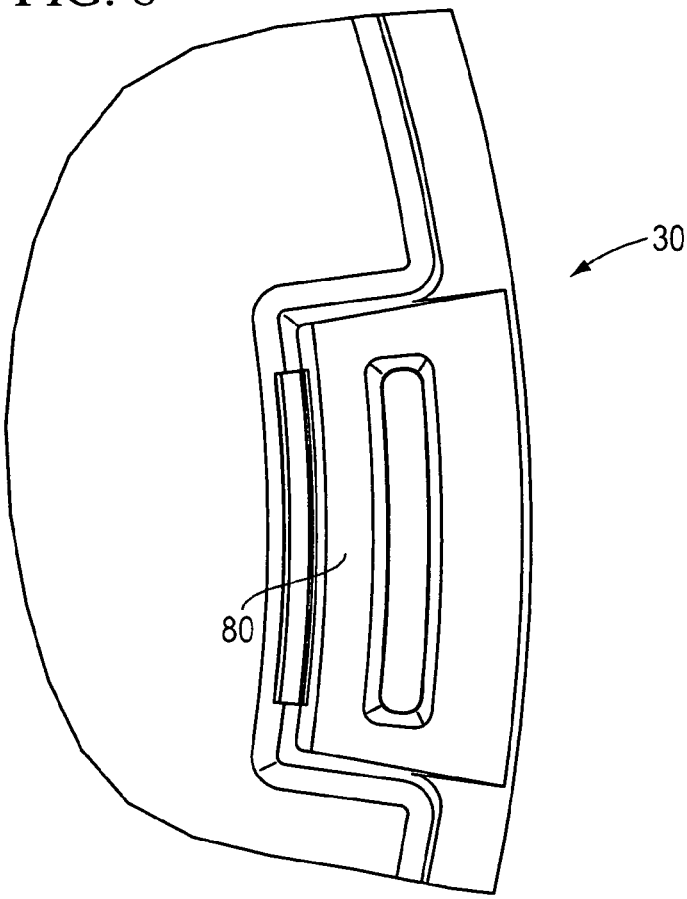
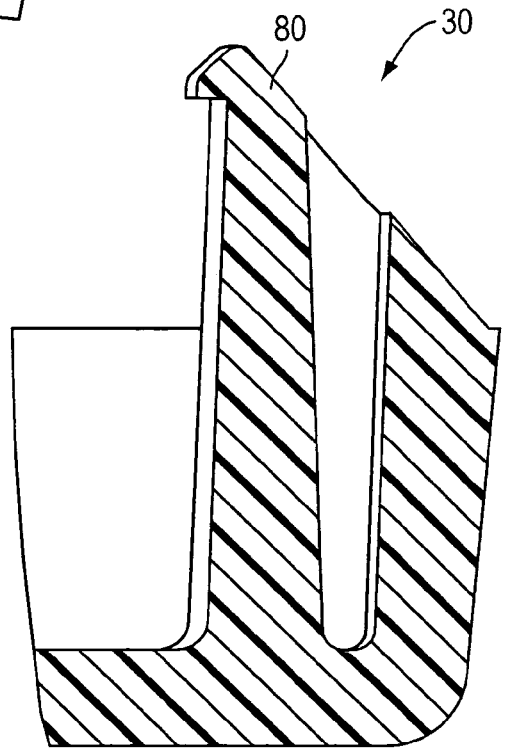
FIG. 9

FIG. 10
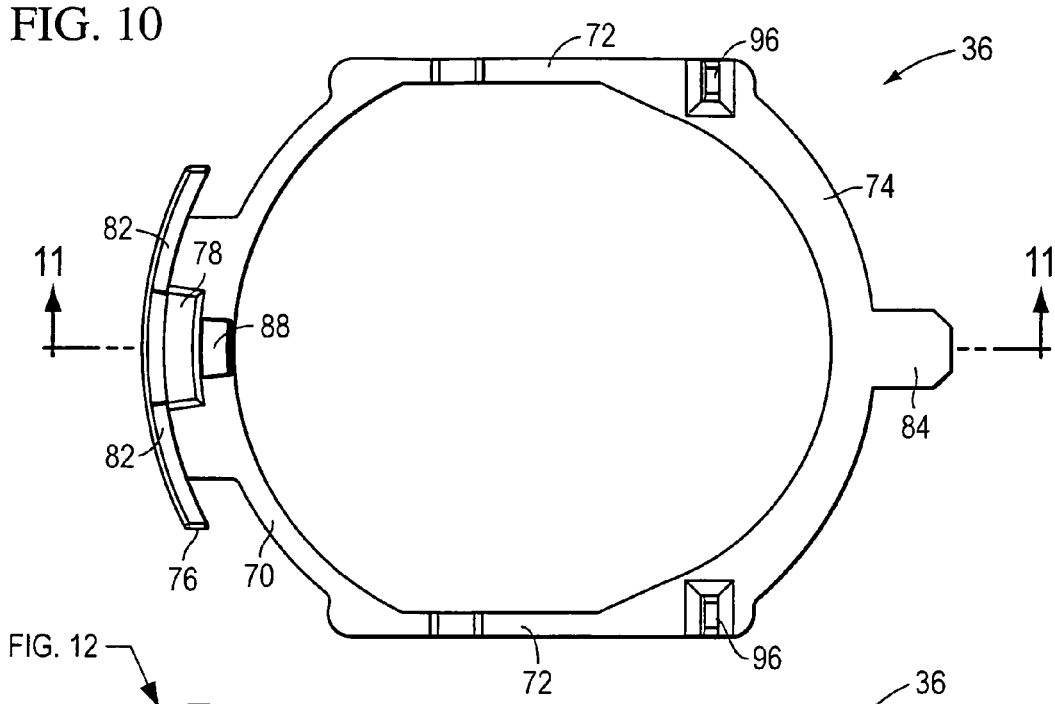
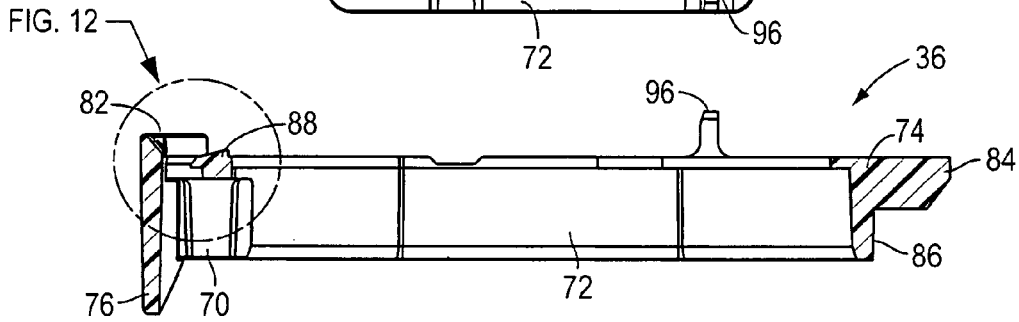
FIG. 11
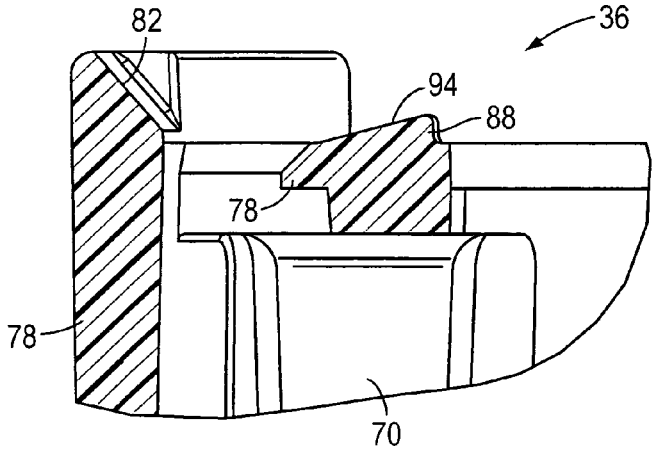
FIG. 12

CLOSURE WITH LID AND SLIDABLE LATCH SYSTEM

TECHNICAL FIELD

This invention relates to container closures for dispensing a fluent substance. The invention is more particularly related to a dispensing closure system that is especially suitable for a hand-held container and that has a lid that can be opened and closed. Notably, the closure system of the present invention includes a slidable latch element mounted on a closure base of the system, which element desirably acts to releasably retain the lid in a closed position, and cooperates with the lid to urge the lid into an open position thereof.

BACKGROUND OF THE INVENTION AND TECHNICAL PROBLEMS POSED BY THE PRIOR ART

Fluent materials, including liquids, creams, powders, etc., may be conventionally packaged in a container having a dispensing closure which includes a covering body that is over an open end of the container and that defines one or more dispensing orifices communicating with the container interior. A cap or lid is typically provided for being releasably secured to the covering body for occluding the dispensing orifice(s) when the container is not in use. This prevents spillage if the container is dropped or tipped over. The lid may also help keep the contents fresh and may reduce the ingress of contaminants.

The inventors of the present invention have discovered a novel closure system for dispensing a fluent substance, including liquid, wherein the closure system includes advantageous features not heretofore taught or contemplated by the prior art.

SUMMARY OF THE INVENTION

According to the present invention, an improved dispensing closure system is provided for a container that has an opening to the container interior where a fluent substance may be stored. The system maintains the lid latched closed until it is opened by the user. The system accommodates a spring-biased movement of the lid to the open position without requiring the user to lift the lid. Optionally, the system can be designed so that a "click" sound can be generated as the lid latch is released.

The dispensing closure system includes a body or base extending across the container opening. The base includes a dispensing orifice through which a substance stored in the container can be dispensed.

The closure system also includes a lid, and a hinge attaching the lid to the closure body or base so as to accommodate movement of the lid between (i) a closed position occluding the dispensing orifice, and (ii) a fully open position away from the closed position to permit dispensing of a substance from the container through the dispensing orifice.

In accordance with the illustrated embodiment, the closure base of the present dispensing closure system includes a deck which defines the dispensing orifice therein, and a skirt depending from the deck. Movement of the associated lid relative to the deck, to thus open and close the dispensing orifice, is effected by providing the lid with an integral hinge by which the lid is hingedly connected to the closure base.

In order to releasably retain the hinged lid in a closed position with respect to the closure base, the closure system includes a slidable latch body, or sliding element, slidably mounted on the closure base for generally lateral movement with respect thereto. The sliding element is movable from a latched position to an unlatched position, with the sliding element including a latch portion engageable with the associated lid when the lid is in its closed position, and the sliding element is in its latched position. The sliding element is movable generally laterally of the closure base from the latched position to disengage the latch portion from the lid, to thereby permit movement of the lid from its closed position to its open position. This permits dispensing of the fluent substance from within the container through the dispensing orifice.

In the illustrated embodiment, the present dispensing closure system is illustrated for use with a container that has an annular top defining (1) an opening, and (2) an external, male thread around the opening. In the illustrated embodiment, the closure system is a dispensing closure that is separate from, but releasably attachable to, the container around the container opening. To this end, the closure base has a hollow, generally cylindrical internal collar, positioned inwardly of the skirt portion in the illustrated embodiment, with the collar depending from the deck of the closure base. The internal collar includes an internal, female thread for threadingly engaging the male thread on the container.

In accordance with the illustrated embodiment, the closure base of the dispensing closure system includes a spout that extends outwardly from the deck to thereby define the dispensing orifice.

A number of features of the present dispensing closure system facilitate convenient manipulation by consumers, while at the same time desirably acting to retain the lid of the system in a closed position, attendant to ordinary shipment, storage, and handling of containers to which the closure system is fitted. The sliding element of the closure system preferably includes at least one camming surface engageable with the lid of the system, in the closed position thereof, when the sliding element is in its latched position. By this arrangement, lateral movement of the sliding element relative to the closure base from its latched position causes the camming surface to urge the lid out of its closed position toward the open position thereof. The lid may be fitted with a suitable sealing element which extends into the dispensing orifice, with movement of the lid from its closed position to its open position acting to disengage the sealing element from the dispensing orifice for dispensing the contents of the associated container.

Manipulation of the sliding element is facilitated by the provision of a button portion configured for manipulation by consumers to move the sliding element laterally of the base portion from the latched position to the unlatched position. In the illustrated embodiment, the button portion defines a camming surface of the sliding element.

In the preferred form, the sliding element further includes a distal pusher portion, positioned distally of the button portion, with the distal pusher portion further defining another camming surface for engagement with the closure lid, so that lateral movement of the sliding element from the latched position to the unlatched position moves the pusher portion into engagement with the lid, to thereby urge the lid toward the open position thereof.

In one presently preferred embodiment, the sliding element of the present closure system has a generally ring-shaped configuration, and is mounted beneath the deck of the closure base, generally between the cylindrical, internal collar of the closure base, and the skirt thereof. The sliding element can be snap-fitted into the closure base during assembly of the closure system, and is thereafter retained generally within the base for the desired lateral sliding movement with respect thereto.

Convenient use of the present dispensing closure system is further facilitated by configuring the sliding element to include an indicator portion, engageable with the closure base as the sliding element is moved laterally of the closure base from the latched position to the unlatched position. The indicator portion desirably acts to provide an audible indication, such as a "click", that the latch portion of the sliding element has been disengaged from the lid. This audible indication is preferably provided in conjunction with manipulation of the button portion, whereby the latch portion of the sliding element is disengaged from the lid, and the lid is urged from its closed position to its open position by cooperation of the one or more camming surfaces of the sliding element with the lid. In the preferred form, the sliding element defines a stop surface engageable with the closure base as the sliding element is moved laterally of the closure base into the unlatched position thereof to limit lateral movement of the sliding element, and thus desirably prevent the sliding element from excessively stressing the closure lid.

The dispensing closure system components can be designed for easily accommodating the assembly of the components during manufacture of the closure system.

The dispensing closure system can be provided with a design that accommodates efficient, high quality, large volume manufacturing techniques with a reduced product reject rate.

The dispensing closure system can optionally be designed to accommodate its use with a variety of conventional or special containers having a variety of conventional or special container finishes, including conventional threaded, or snap-fit, attachment configurations.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 8 is a greatly enlarged, fragmentary, plan view of the portion of the closure shown in FIG. 6 within the circle designated "FIG. 8";

FIG. 9 is a greatly enlarged, fragmentary, cross-sectional view of a portion of the closure shown in FIG. 7 within the circle designated "FIG. 9";

FIG. 10 is a top plan view of the slidable latch body or slider or button or slidable member shown in FIG. 4 and prior to installation in the closure base;

FIG. 11 is a cross-sectional view taken generally along the plane 11-11 in FIG. 10;

FIG. 12 is a greatly enlarged, fragmentary, cross-sectional view of the portion of the base shown in FIG. 11 within the circle designated "FIG. 12";

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, many of the figures illustrating the invention show the dispensing closure system as including a separate, removable, dispensing closure in the typical orientation that the closure would have at the top of a container when the container is stored upright on its base, and terms such as upper, lower, horizontal, etc., are used with reference to this position. It will be understood, however, that the closure system of this invention may be manufactured, stored, transported, used, and sold in an orientation other than the orientations described.

The dispensing closure system of this invention is suitable for use with a variety of conventional or special fluent substance dispensing systems, including packages, articles, and other dispensing equipment or apparatus, the details of which, although not fully illustrated or described, would be apparent to those having skill in the art and an understanding of such fluent substance dispensing systems. Such a fluent substance dispensing system, or portion thereof, with which the inventive dispensing closure system cooperates is hereinafter simply referred to as a "container." The particular container, per se, that is illustrated and described herein forms no part of, and therefore is not intended to limit, the present invention. It will also be understood by those of ordinary skill that novel and non-obvious inventive aspects are embodied in the described exemplary dispensing closure system alone.

The Dispensing Closure System on a Container

Figure 1:
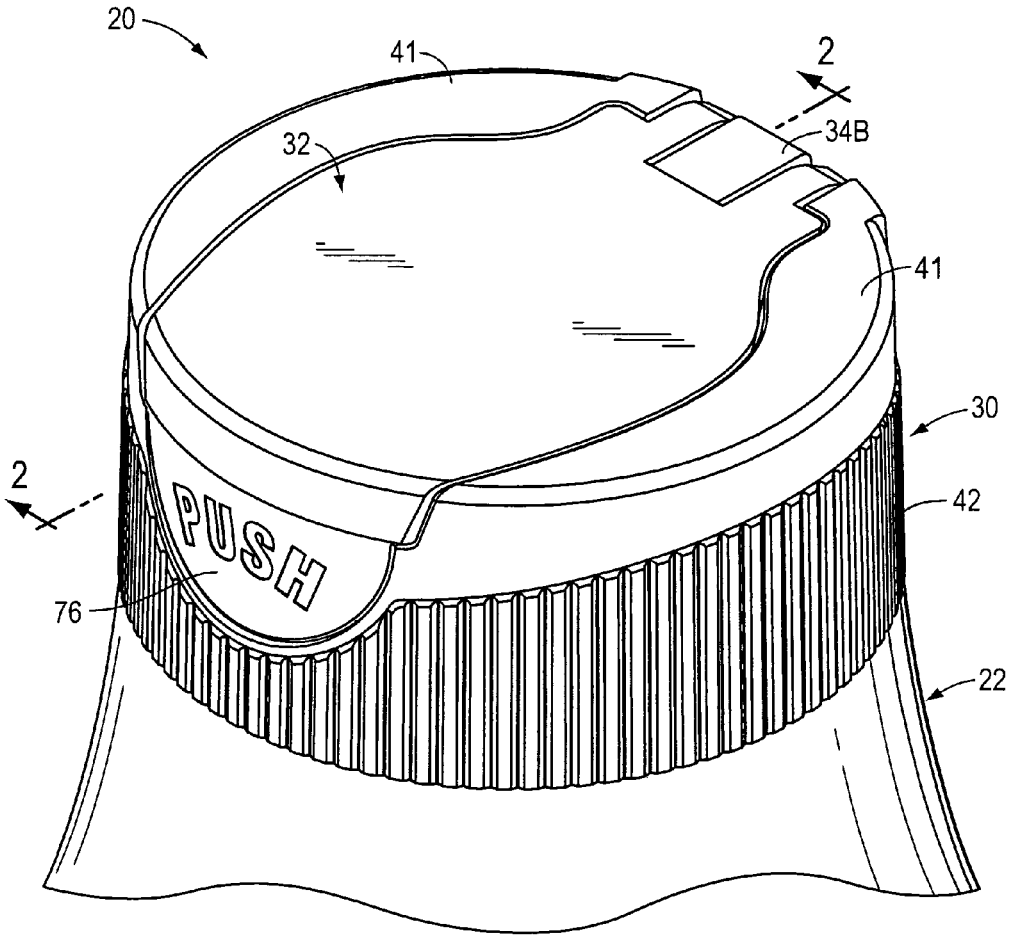
FIG. 1 is a fragmentary, isometric view of a closure system of the present invention in the form of a separate dispensing closure according to a preferred use of the invention, and the closure is shown installed on a container with the closure lid closed.

A preferred embodiment of a dispensing closure system of the present invention is illustrated in the figures and is designated generally therein by reference number 20 in FIG. 1. In the embodiment illustrated, the closure system 20 is provided in the form of a separate dispensing closure 20 which is adapted to be mounted or installed on a container 22 that would typically contain a fluent substance.

The container 22 includes a neck 26 (FIG. 2) extending upwardly from a main hollow body portion of the container. The neck 26 defines an opening 27 (FIG. 2) to the container interior.

Figure 2:
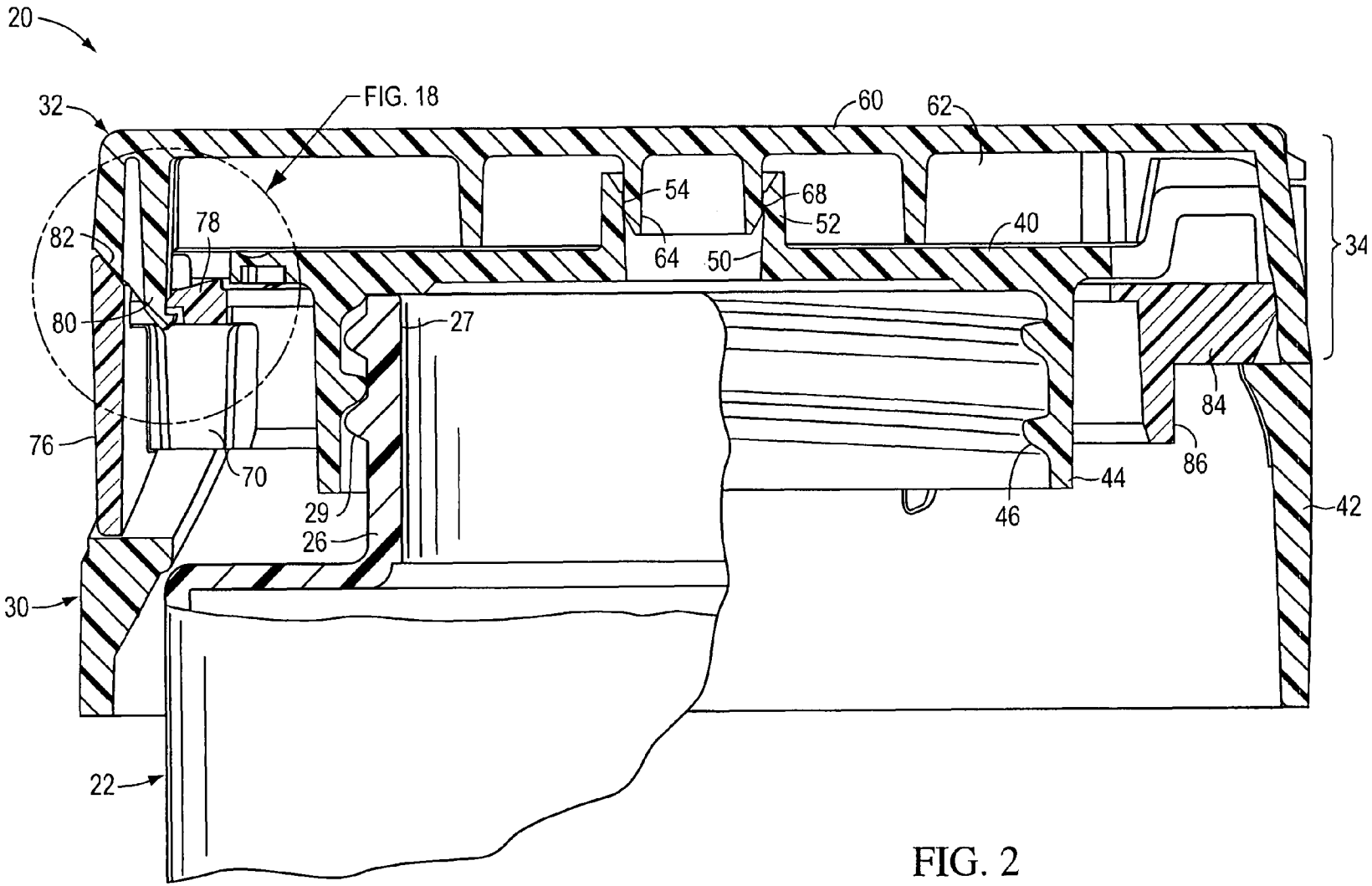
FIG. 2 is a greatly enlarged, fragmentary, cross-sectional view taken generally along the plane 2-2 in FIG. 1.

The container neck 26, in the preferred embodiment illustrated in FIG. 2, has an external, male thread 29 for engaging the dispensing closure system 20. The main body portion of the container 22 may have any suitable configuration, and the upwardly projecting neck 26 may have a different cross-sectional size and/or shape than the container main body portion. (Alternatively, the container 22 need not have a neck 26, per se. Instead, the container 22 may consist of only a main body with an opening.)

Although the container 22, per se, does not form a part of the broadest aspects of the present invention, per se, it will be appreciated that at least a portion of the dispensing closure system 20 of the present invention optionally may be provided as a unitary portion, or extension, of the top of the container 22. However, in the preferred embodiment illustrated, the dispensing closure system 20 is a completely separate article or unit (e.g., a dispensing closure 20), and is adapted to be removably, or non-removably, installed either on a previously manufactured container 22 that has an opening 27 to the container interior or on some other fluent substance handling system. Hereinafter, the dispensing closure system or dispensing closure 20 will be more simply referred to as the closure 20.

The illustrated embodiment of the closure 20 is adapted to be used with a container 22 having an opening 27 to provide access to the container interior and to a product (i.e., a material in the form of a fluent substance) contained therein. The closure 20 can be used to dispense substances, including, but not limited to, liquids, suspensions, mixtures, etc. (such as, for example, a personal care product, an industrial or household cleaning product, or other compositions of matter (e.g., compositions for use in activities involving manufacturing, commercial or household maintenance, construction, agriculture, medical treatment, military operations, etc.)).

The container 22 with which the closure 20 may be used would typically be a squeezable container having a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape. Such a squeezable container is preferred in many applications but may not be necessary or preferred in other applications. For example, in some applications it may be desirable to employ a generally rigid container, and to pressurize the container interior at selected times with a piston or other pressurizing system, or to reduce the exterior ambient pressure around the exterior of the closure so as to suck the material out through the open closure.

It is presently contemplated that many applications employing the closure 20 will conveniently be realized by molding at least some of the components or portions of the closure 20 from suitable thermoplastic material or materials. In the illustrated embodiment, the components of the closure could be molded from a suitable thermoplastic material, such as, but not limited to, polypropylene. The closure components may be molded from different materials. The materials may have the same or different colors and textures.

The General Arrangement of the Closure Components

Figure 4:
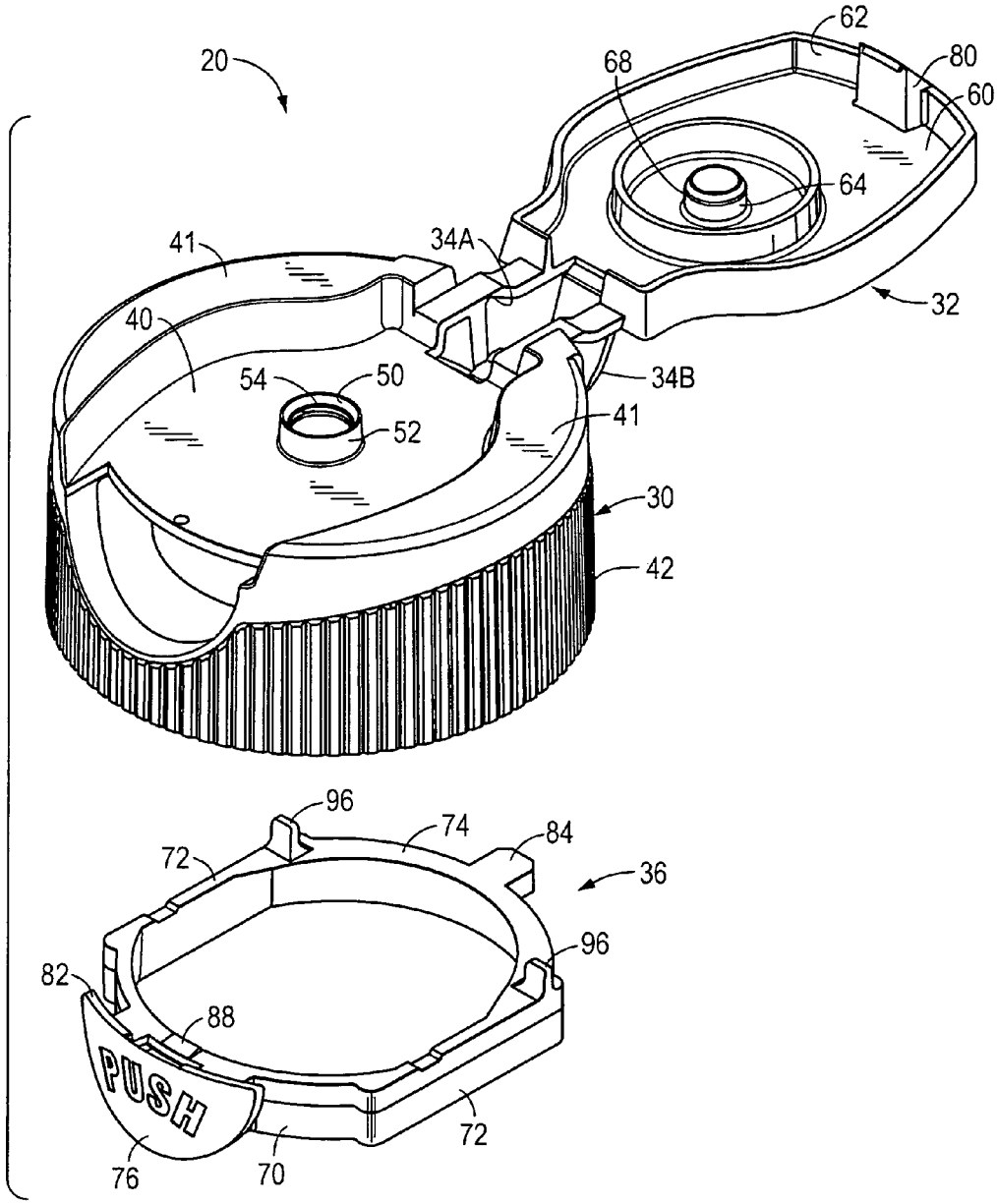
FIG. 4 is an exploded, isometric view of the closure components shown in FIG. 3 with the lid in the opened condition and as viewed from above.

As can be seen in FIG. 4, the presently most preferred form of the closure 20 includes four basic components: (1) a unitary molded body or base 30, (2) a lid 32, (3) a hinge 34 connecting the lid 32 to the base 30, and (4) a slidable latch body 36 that is slidable in the base 30. The latch body 36 may also be described as a "button," or a "sliding body" or a "sliding element" or a "slider."

In the preferred form of the embodiment of the invention, the lid 32 is provided to be closed over, and cover, the upper part of the closure base 30. The lid 32 can be moved to expose the upper part of the base 30 for dispensing. The lid 32 is movable between (1) a closed position over the base 30 (as shown in FIG. 1), and (2) an open position (as show in FIG. 3). In the illustrated embodiment, the lid 32 is hinged to the base 30 so as to accommodate pivoting movement of the lid 32 between the closed position and the open position.

The Hinge

Figure 5:
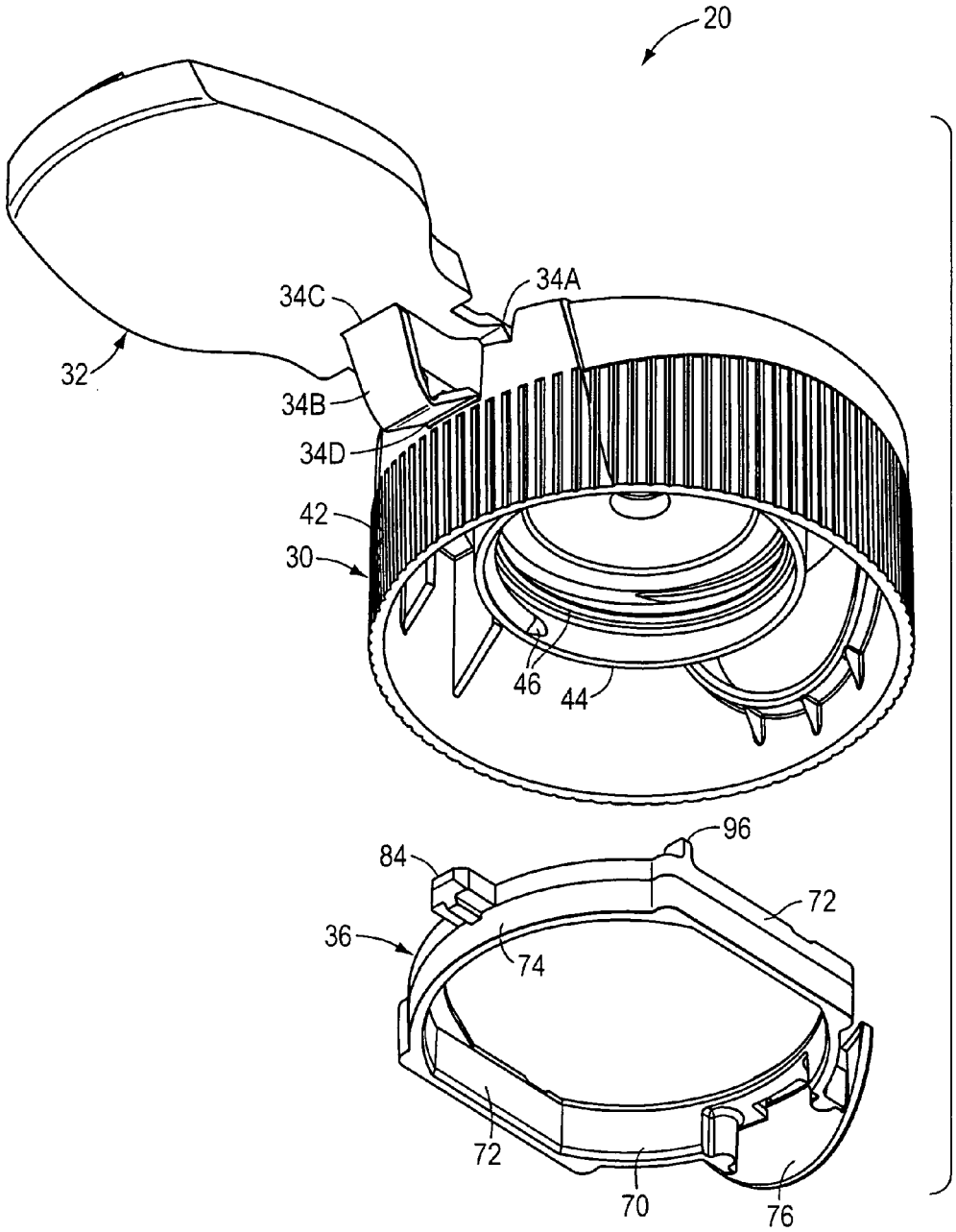
FIG. 5 is a view similar to FIG. 4, but in FIG. 5 the closure components are viewed from the rear of the closure below the components.
Figure 6:
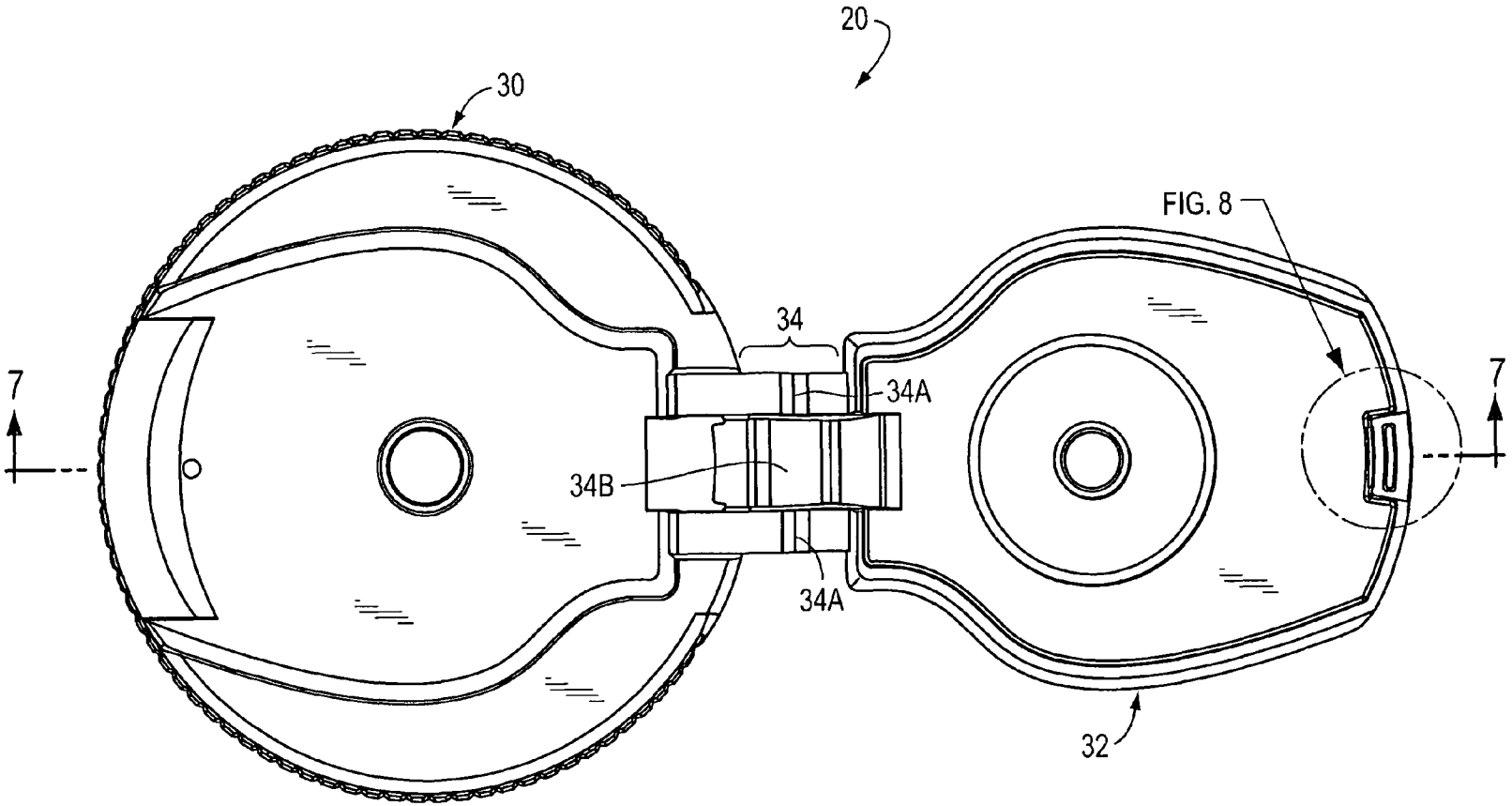
FIG. 6 is a top plan view of the opened closure base shown in FIG. 4.
Figure 7:
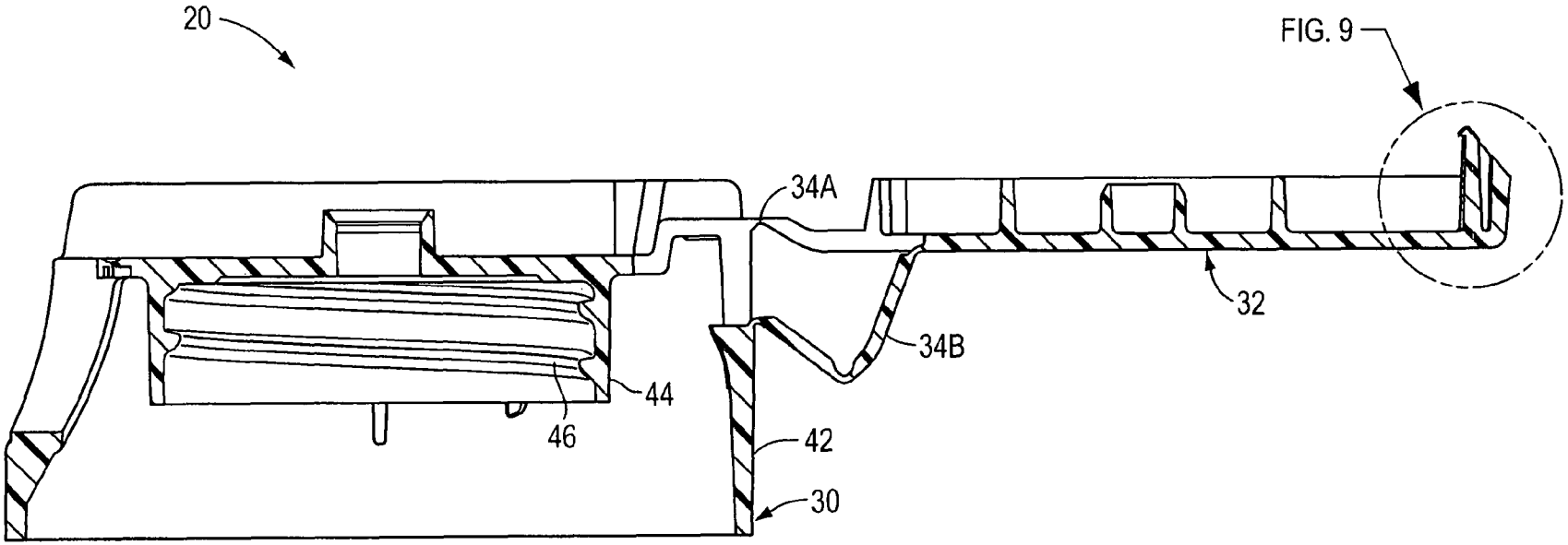
FIG. 7 is a cross-sectional view taken generally along the plane 7-7 in FIG. 6.
Figure 13:
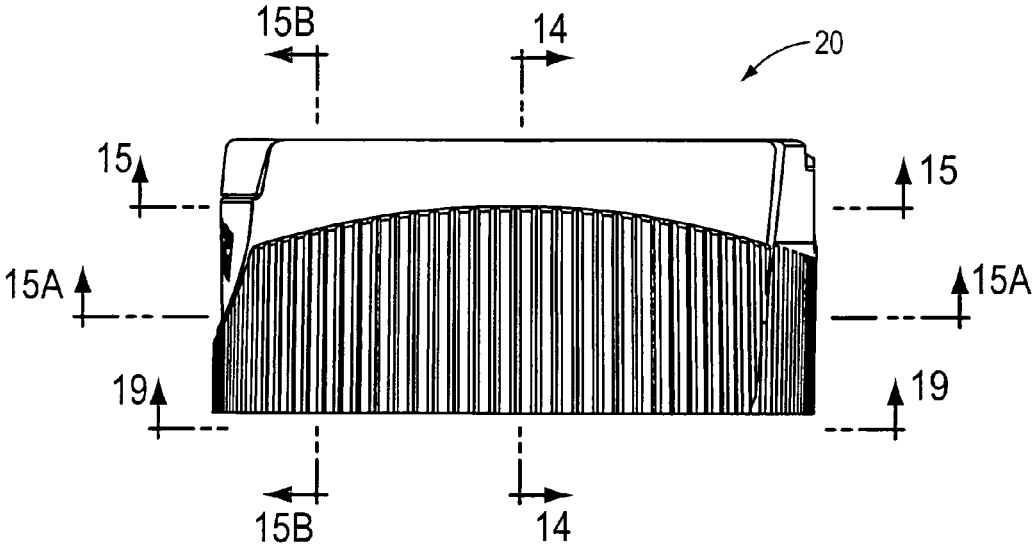
FIG. 13 is a side elevational view of the closed closure shown in FIG. 1, but in FIG. 13 the container has been omitted for ease of illustration.
Figure 15B:
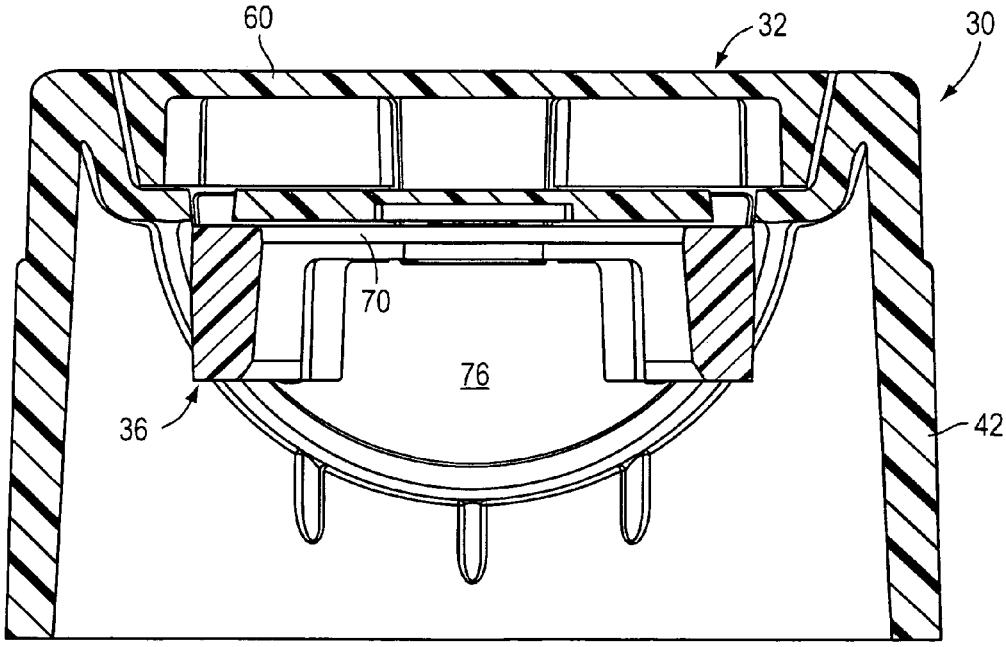
FIG. 15*b* is a greatly enlarged, cross-sectional view taken generally along the plane 15*b*-15*b* in FIG. 3.
Figure 23:
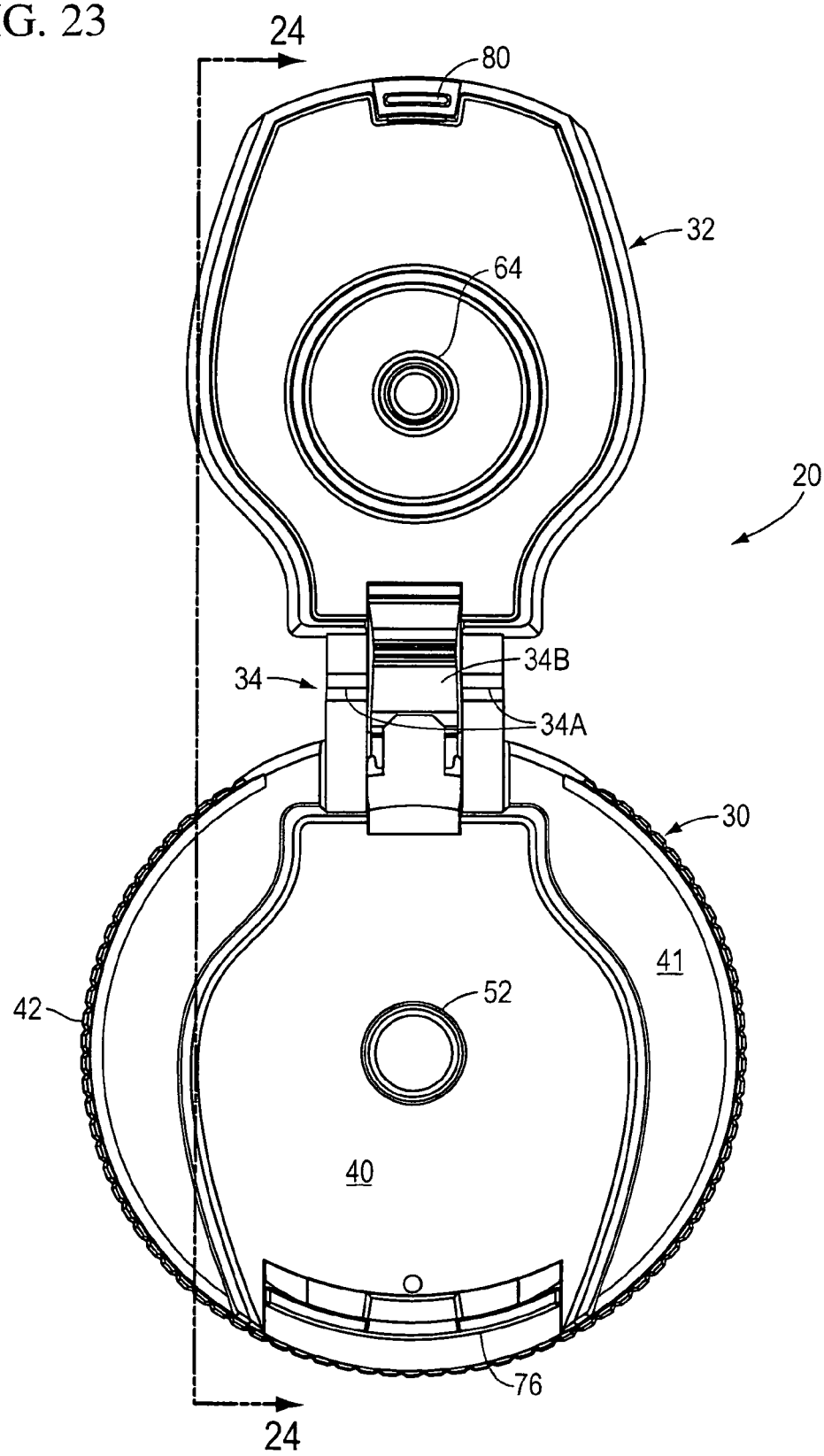
FIG. 23 is a top plan view of the open closure shown in FIG. 3.
Figure 24:
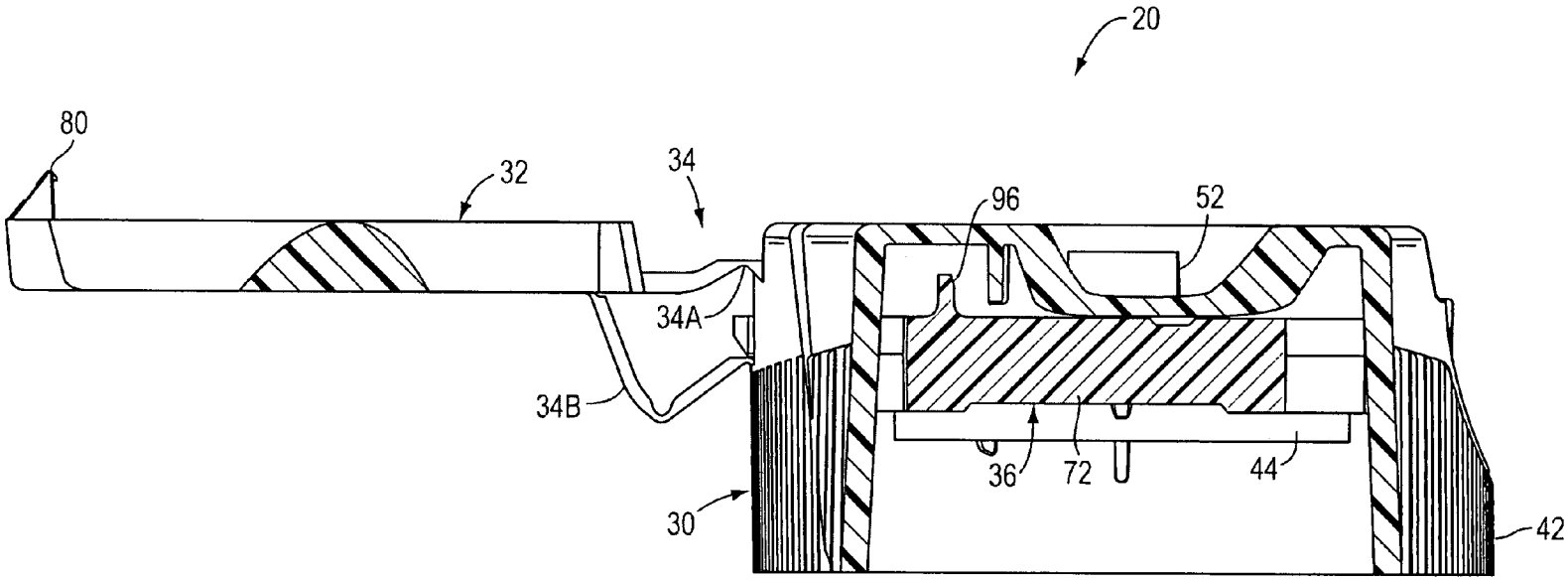
FIG. 24 is an enlarged, cross-sectional view taken generally along the plane 24-24 in FIG. 23.

In the preferred embodiment illustrated, the lid 32 is connected to the closure base 30 via the hinge 34 which is of the conventional snap-action type that may be conveniently molded from a suitable thermoplastic material to include two spaced-apart film hinges 34A (FIGS. 4 and 23) and an offset connecting spring link 34B provided on the lid 32. One end of the link 34B is connected to the remaining portion of the lid 32 via a film hinge 34C (FIG. 5), and the other end is connected to the closure base skirt 42 via a film hinge 34D.

The above-described snap-action hinge structure permits the lid 32 to be moved between the open and closed positions because the link 34B deforms elastically through a dead center position at which the link 34B is maximally deformed. On either side of the dead center position, the deformation of the link 34B is at least partly reduced, and the lid 32 is thus urged to a stable position at the end of its travel range on that side of the dead center position. Thus, when the lid 32 is in the closed position (FIG. 1), it is self-maintained in the closed position. On the other hand, when the lid 32 is open (FIG. 3), it is self-maintained in that position to accommodate dispensing of the contents without having to use one's fingers to hold the lid 32 out of the way.

Figure 3:
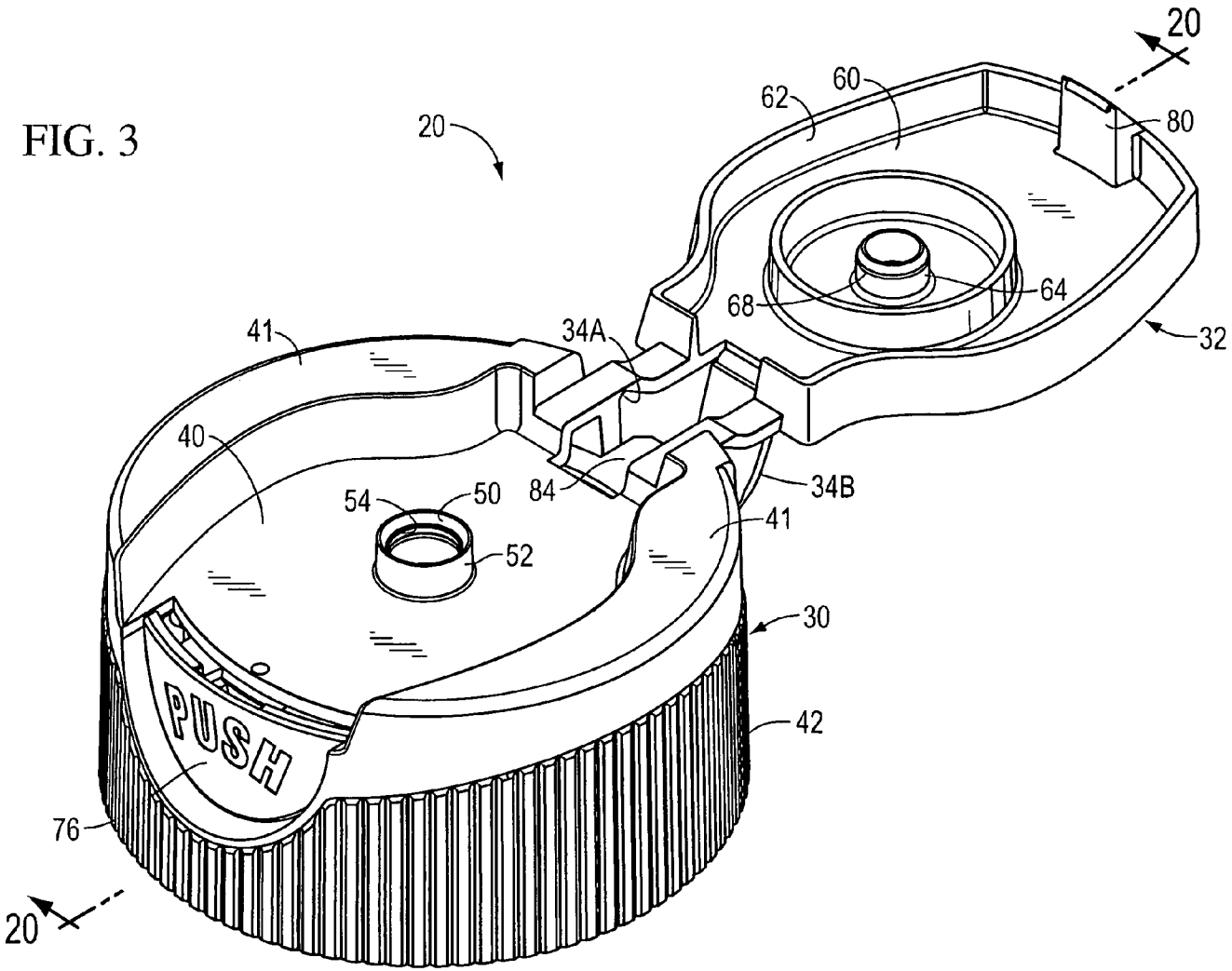
FIG. 3 is a view similar to FIG. 1, but in FIG. 3 the closure is shown with the lid in the full opened condition and with the container omitted for ease of illustration.

As can be seen in FIG. 3, the base 30 includes a recessed deck 40 between a pair of spaced-apart, raised, upper deck portions 41. A skirt 42 extends downwardly on the closure base 30 as shown in FIGS. 2 and 3. As can be seen in FIGS. 2, 5, 21, and 24, an internal collar 44 is located within the skirt 42, and the collar 44 extends downwardly from the recessed deck 40 for engaging the container neck 26 when the closure base 30 is mounted on the container 22 as shown in FIG. 2. As can be seen in FIG. 2, the interior of the internal collar 44 defines an internal, female thread 46 for threadingly engaging the container neck external, male thread 29 (FIG. 2) when the dispensing closure base 30 is installed on the container neck 26.

Alternatively, the closure base internal collar 44 could be provided with some other container connecting means, such as a snap-fit bead or groove (not illustrated) for engaging a container neck groove or bead (not illustrated), respectively. Also, the closure base internal collar 44 could instead be permanently attached to the container 22 by means of induction melting, ultrasonic melting, gluing, or the like, depending on materials used for the closure base internal collar 44 and container 22. In another alternate design (not illustrated), the closure base internal collar 44 could be formed as a unitary part, or extension, of the container 22.

Although not illustrated, an annular seal member could optionally be provided to extend downwardly from the underside of the closure base deck 40 to seal against the upwardly facing annular surface of the container neck 26. Such a seal member could be a conventional "V" seal, a conventional "plug" profile seal, a conventional "crab's claw" seal, or some other such conventional or special seal, depending upon the particular application.

The closure base collar 44 may have any suitable configuration for accommodating an upwardly projecting neck 26 of the container 22 or for accommodating any other portion of a container received within the particular configuration of the closure base internal collar 44—even if a container does not have a neck, per se. The main part of the container 22 may have a different cross-sectional shape than the container neck 26 and closure base internal collar 44. The closure base internal collar 44 may be adapted for mounting to other types of fluent substance handling container systems (e.g., including dispensing apparatus, machines, or equipment).

In the illustrated embodiment of the invention, the container neck receiving passage in the closure base internal collar 44 has a generally cylindrical configuration, but includes the inwardly projecting thread 46. However, the closure base collar 44 may have other configurations. For example, the closure base internal collar 44 might have a prism or polygon configuration adapted to be mounted to the top of a container neck having a polygon configuration. Such prism or polygon configurations would not accommodate the use of a threaded attachment, but other means of attachment could be provided, such as a snap-fit bead and groove arrangement, adhesive, or the like.

Figure 21:
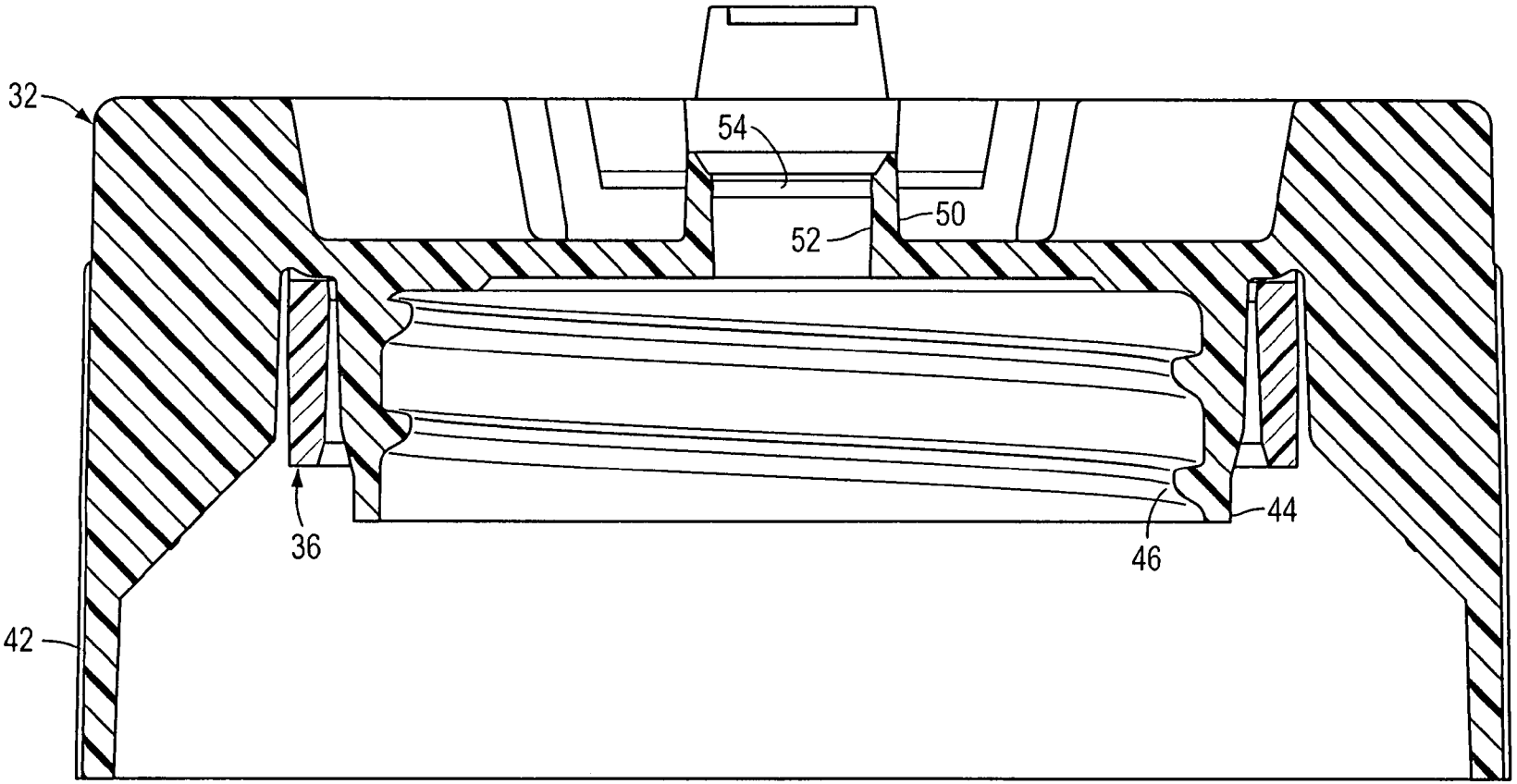
FIG. 21 is a greatly enlarged, cross-sectional view taken generally along the plane 21-21 in FIG. 20.
Figure 22:
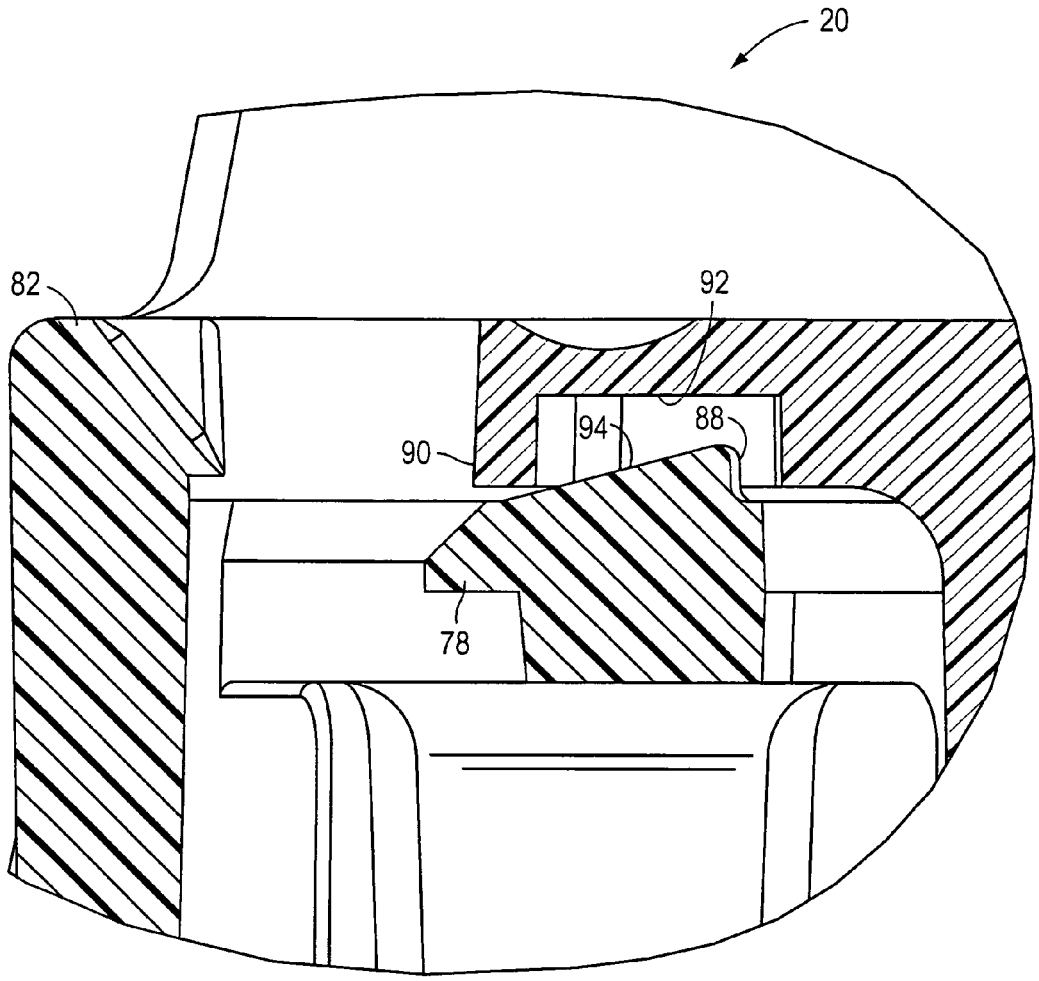
FIG. 22 is a greatly enlarged, fragmentary, cross-sectional view of a portion of the closure shown in FIG. 20 within the circle designated "FIG. 22"

As shown in FIGS. 2 and 3, the closure base 30 has a dispensing orifice 50 defined in a spout 52 which projects upwardly from the recessed deck 40 in the closure base 30. A portion of the inside annular surface of the spout 50 defines a radially inwardly projecting bead 54 (FIGS. 3 and 21). The dispensing orifice 50 establishes communication between the closure exterior and the interior of the closure base 30 (and the interior of the container 22 to which the base 30 is attached). The orifice 50 provides a flow passage or discharge passage through which the contents of the container 22 can be discharged when the lid 32 is open.

Figure 14:
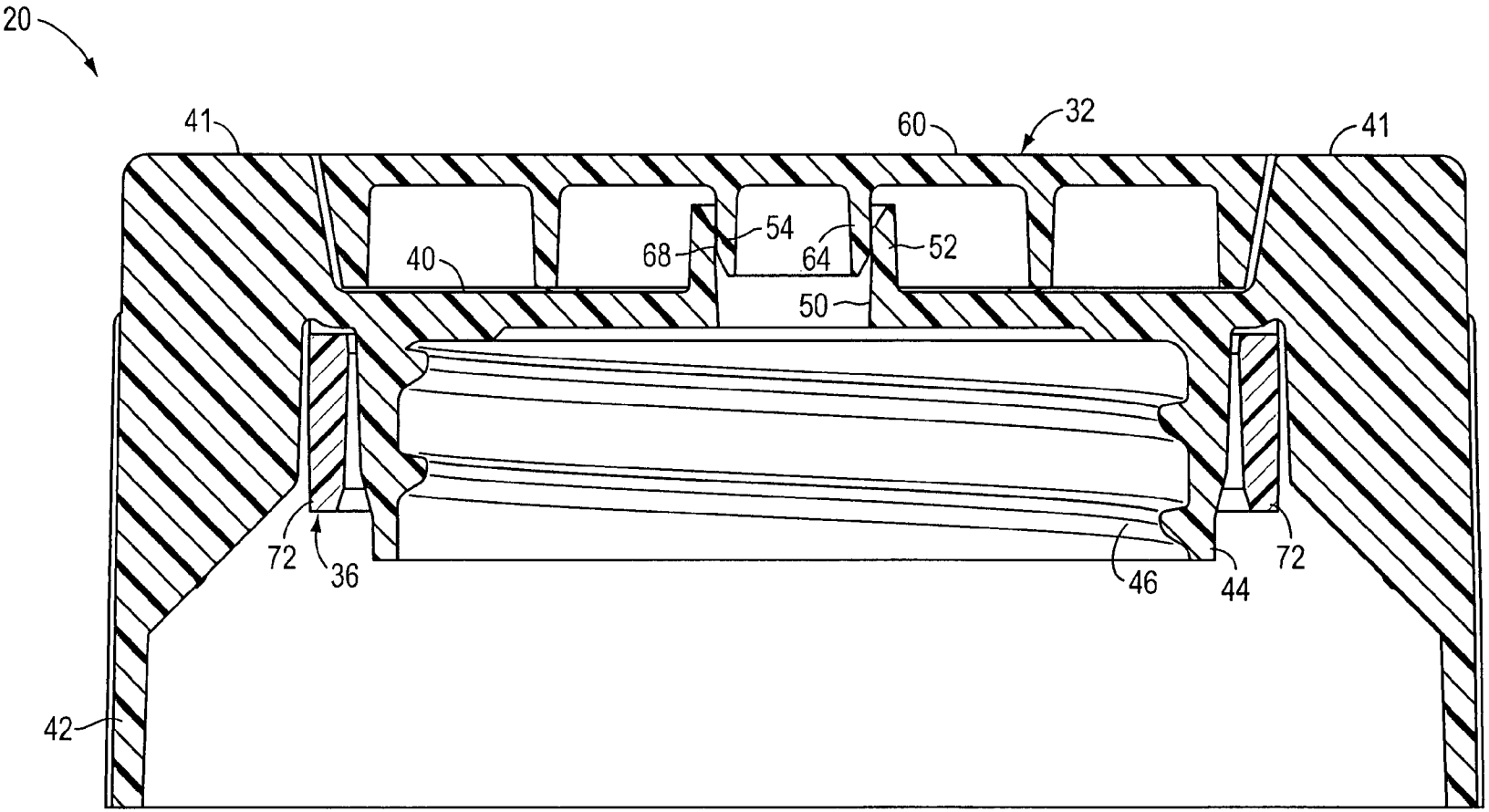
FIG. 14 is a greatly enlarged, cross-sectional view taken generally along the plane 14-14 in FIG. 13.
Figure 15:
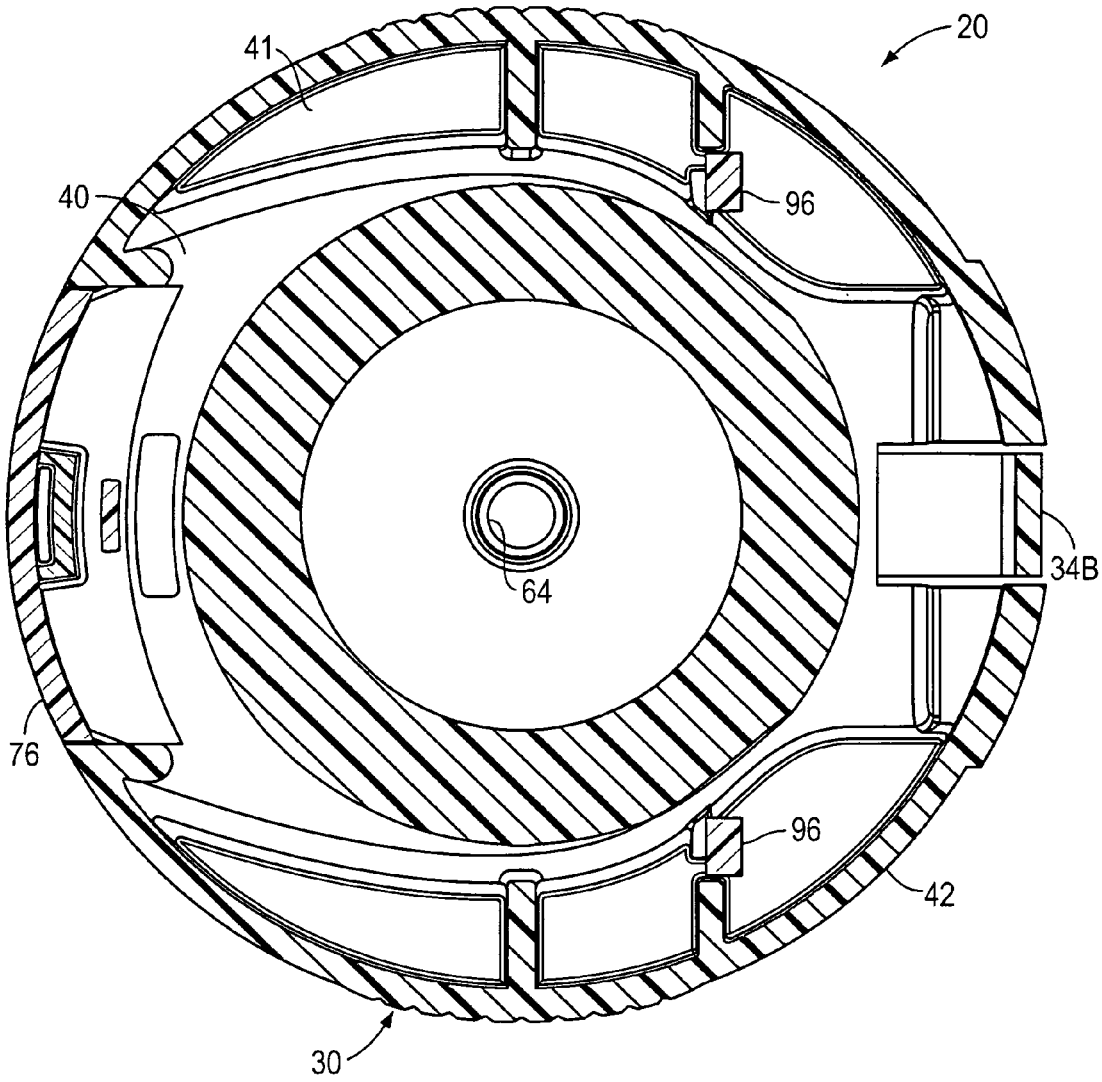
FIG. 15 is a greatly enlarged, cross-sectional view taken generally along the plane 15-15 in FIG. 13.
Figure 15A:
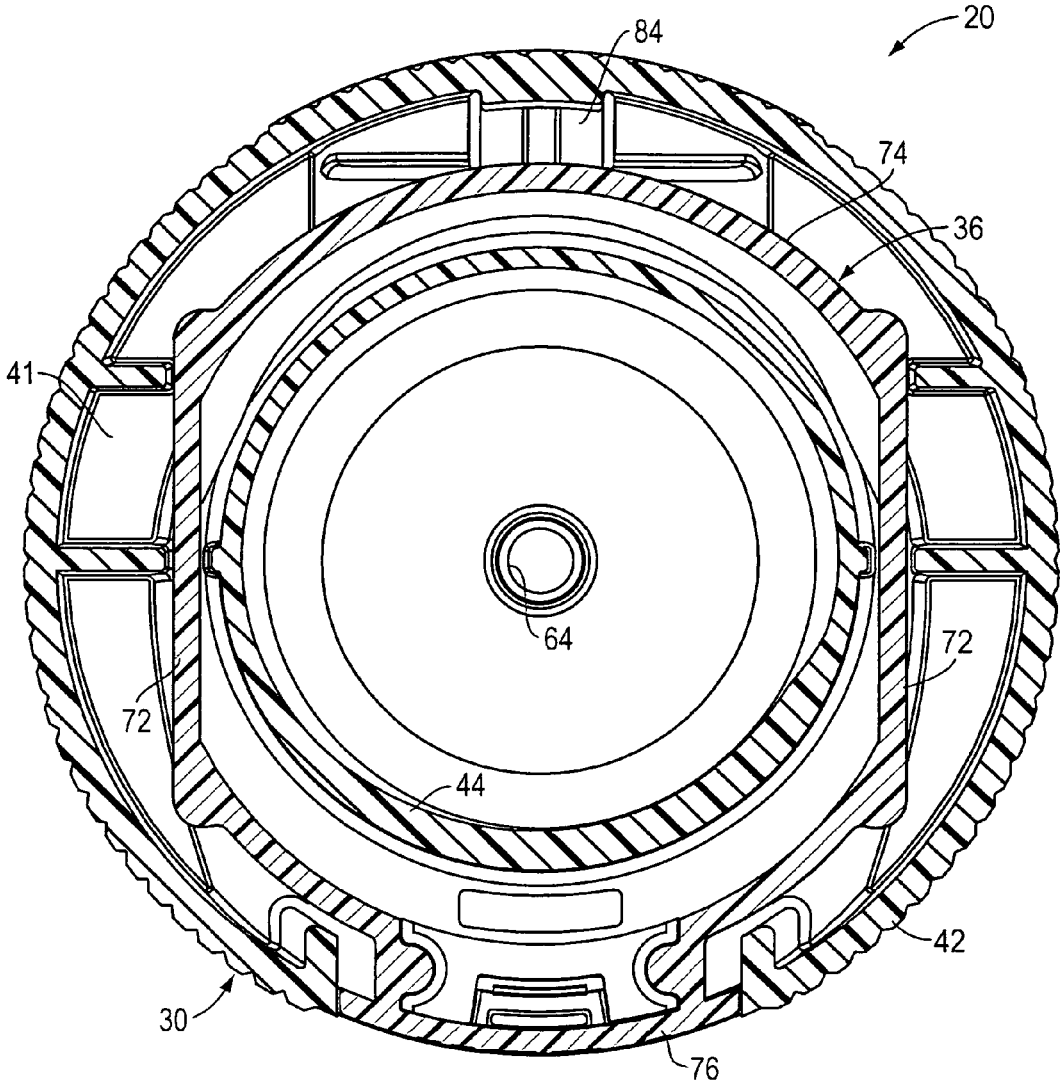
FIG. 15*a* is a greatly enlarged, cross-sectional view taken generally along the plane 15*a*-15*a* in FIG. 3.
Figure 16:
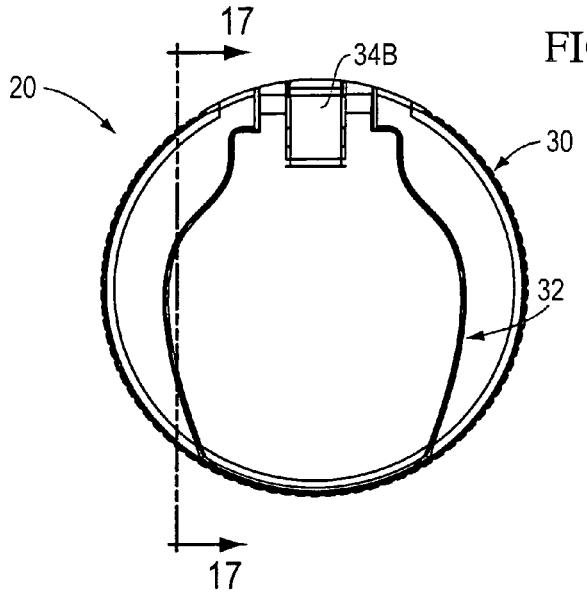
FIG. 16 is a top plan view of the closed closure shown in FIG. 13.

As can be seen in FIGS. 2 and 3, the lid 32 includes a top wall or cross wall 60 and a peripheral wall 62 which, when the lid 32 is closed top of the recessed deck 40, has a downwardly projecting orientation for fitting between the closure base raised deck portions 41. As can be seen in FIGS. 2 and 3, the lid 32 also has a spud 64 which projects from the transverse wall 60 on the underside of the lid 32. The spud 64 includes an annular seal bead 68 (FIGS. 2, 3, 4, and 14). There is sufficient resiliency in the lid spud 64 and/or closure base spout 52 so as to accommodate the closing of the lid 32 onto the base 30 as shown in FIGS. 2 and 14 wherein the lid spud seal bead 68 can pass beyond and below the closure base spout seal bead 54 to establish a snap-fit engagement of the lid 32 to the base 30 and to provide a substantially leak-tight seal at the closure base spout orifice 50. The closure base spout seal bead 54 and the closure lid spud seal bead 68 provide a significant resistance to subsequent opening of the lid 32. A sufficient amount of force must be exerted upon the lid 32 in the upward direction in order to disengage the seal beads 54 and 68 to allow the lid 32 to be opened.

In accordance with the present invention, the sliding element 36 of the present closure system facilitates convenient manipulation of the system to move the lid 32 from its closed to its open position, while at the same time desirably acting to releasably retain the lid in its closed position by the provision of a latching arrangement. As illustrated in FIGS. 4, 5, 10, and 11, the sliding element 36 has a generally ring-shaped configuration, including a front portion 70, a pair of generally parallel side portions 72, and a rear portion 74. A button portion 76 is provided at the front portion 70 for convenient manipulation by users, with the sliding element further defining, generally at a top surface of front portion 70, a latch portion 78 configured for releasable engagement with a lid latch portion 80 of the associated lid 32.

In accordance with a presently preferred embodiment, the sliding element 36 is mounted for generally sliding, reciprocable movement on the closure base 30, with the illustrated embodiment configured such that the sliding element is mounted generally within the closure base, generally beneath the recessed deck 40. In addition to providing the desired releasable retention of the associated lid 32 in its closed position, by cooperative engagement of latch portion 78 with lid latch portion 80, the sliding element 36 is preferably configured to define one or more camming surfaces which coact with the lid 32 to urge the lid from its closed to its open position, attendant to sliding movement of the sliding element 36 from a latched position to an unlatched position thereof. In the illustrated embodiment, button portion 76 defines camming surfaces 82 for cooperative engagement with a forward edge portion of the lid 32. Additionally, the sliding element further preferably includes a distal pusher portion 84, positioned distally of button portion 76, on rear portion 74 of the sliding element. The pusher portion further defines a camming surface for cooperative engagement and coaction with link 34B of cap 32.

Thus, attendant to sliding actuation of the sliding element 32 from its latched position, illustrated in FIG. 2, inward manipulation of button portion 76 acts to disengage latch portion 78 from lid latch portion 80. Concurrently, camming surfaces 82 at the button portion coact with the forward portion of the lid, while substantially simultaneously the pusher portion 84 cooperates with the link 34B to urge the lid from its closed position to its open position. Attendant to actuation of the sliding element in this fashion, and movement of the lid 32 from its closed position, the spud 64 is moved out of sealing engagement within the dispensing orifice 50, thus moving the dispensing closure system to a configuration to facilitate dispensing of the fluent substance in the associated container.

In the preferred embodiment, the sliding element 36 defines a stop surface 86, generally at rear portion 74 beneath pusher portion 84. The stop surface 86 is engageable with an inwardly facing surface of closure base skirt 42 and desirably acts to limit the range of lateral motion of the sliding element as it is moved from its latched position to its unlatched position. Application of excessive force on the link 34B is thus desirably avoided.

Figure 18:
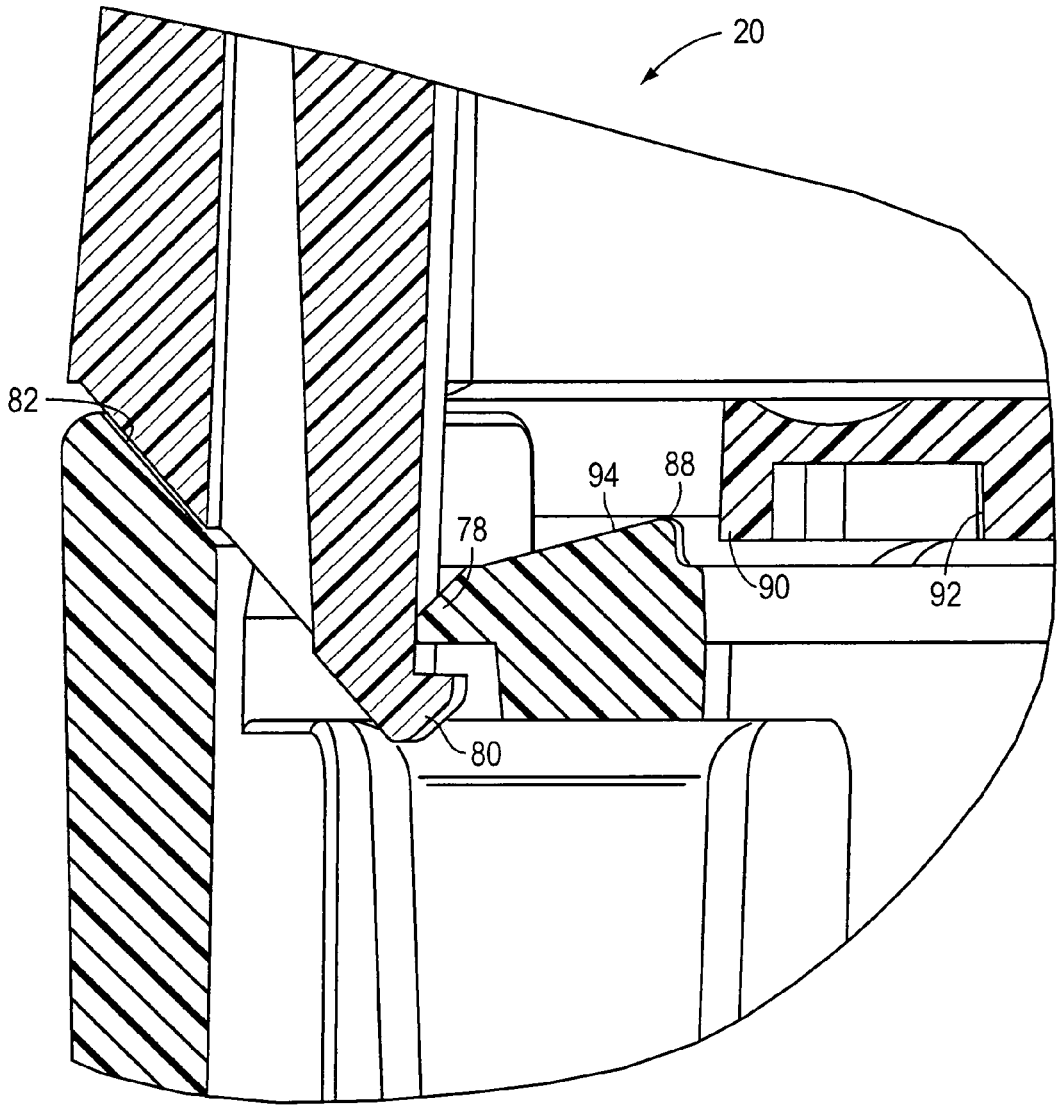
FIG. 18 is a greatly enlarged, fragmentary, cross-sectional view of a portion of the closure shown in FIG. 2 within the circle designated "FIG. 18"
Figure 19:
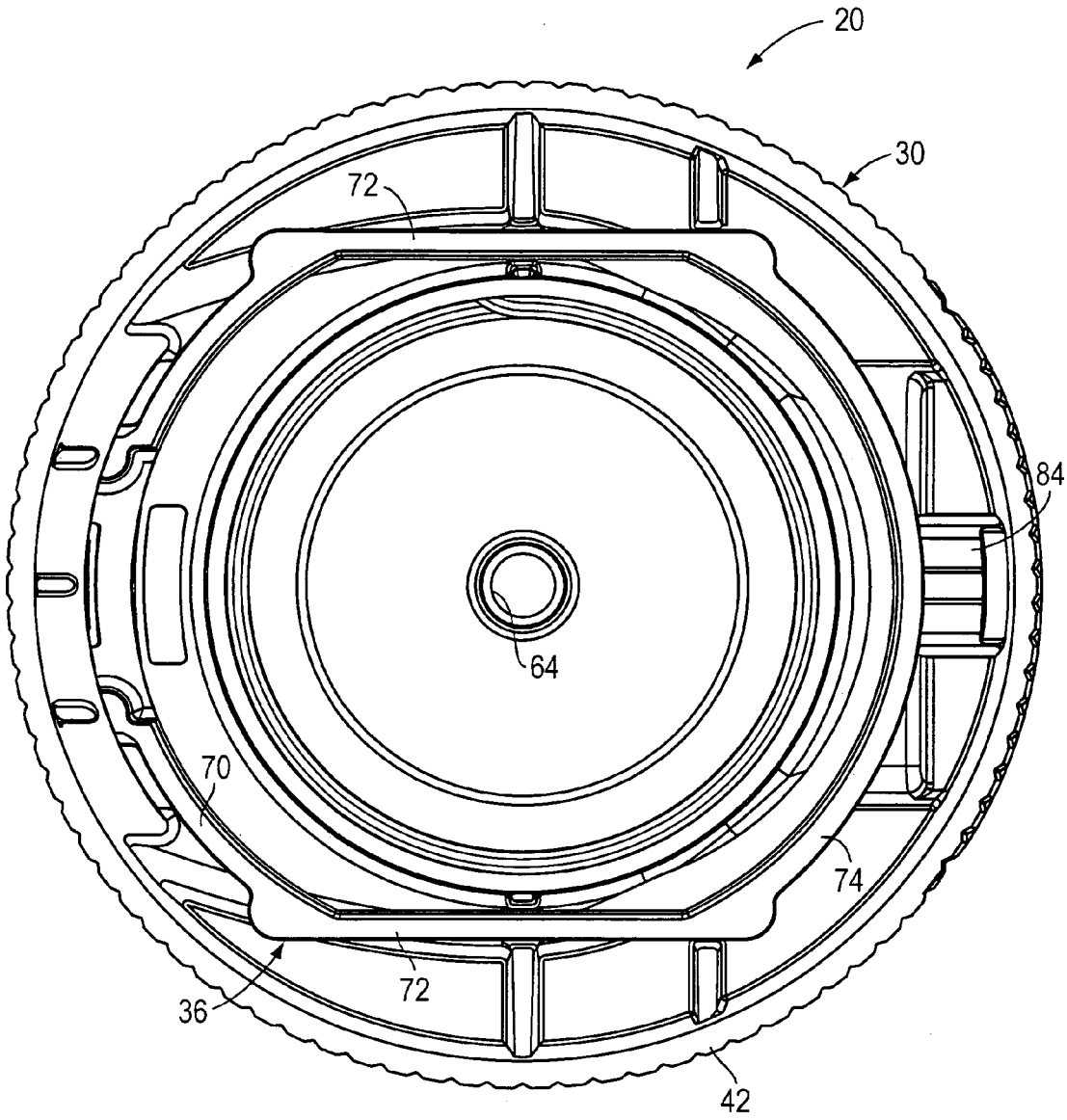
FIG. 19 is a greatly enlarged, bottom plan view taken generally along the plane 19-19 in FIG. 13.
Figure 20:
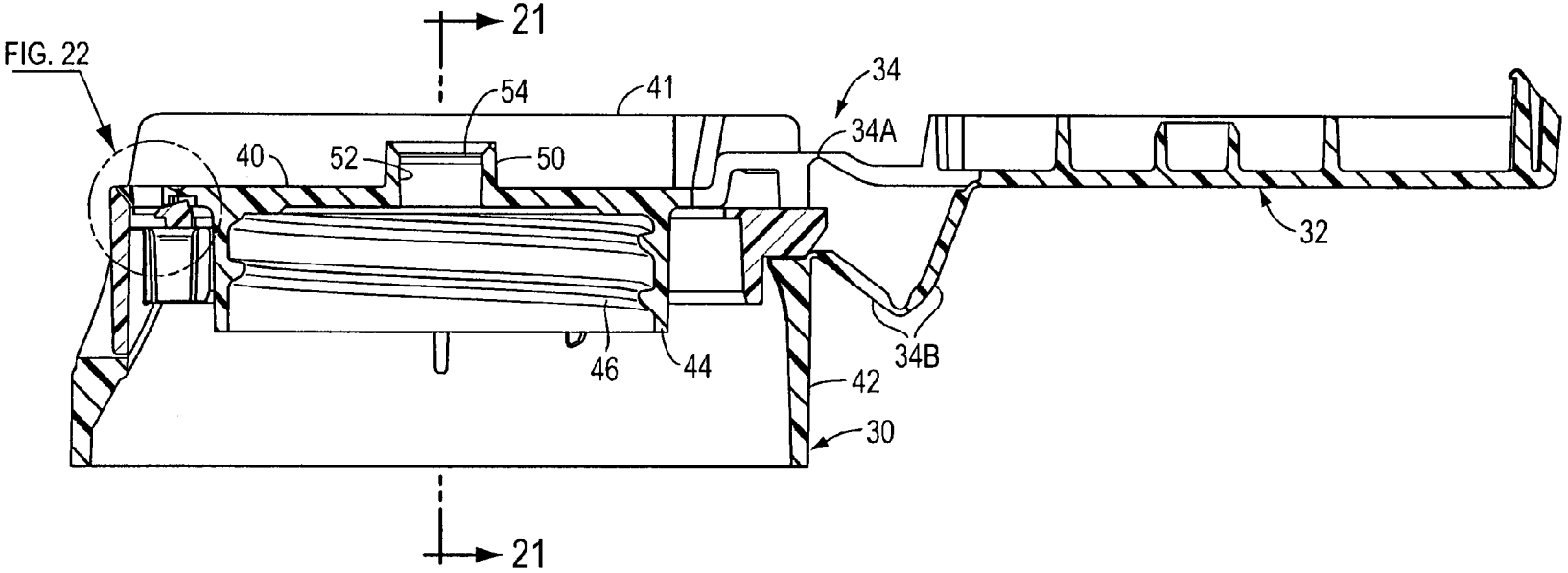
FIG. 20 is a cross-sectional view taken generally along the plane 20-20 in FIG. 3.

Convenient use of the present dispensing closure system by consumers is further facilitated by the preferred provision of an indicator portion 88 on the sliding element 36. Indicator portion 88, provided generally at the top of front portion 70 of the sliding element, is configured for engagement with the associated closure base generally at surface 90 (FIG. 18), attendant to sliding manipulation of the sliding element by manipulation of button portion 76. Engagement of the indicator portion 88 with surface 90 desirably provides an audible indication, such as a "click", as the sliding element 36 is moved from its latched position, thus providing an audible indication that the lid 32 has been unlatched, and that the lid 32 is being opened.

In the unlatched position of the sliding element 36, the indicator portion 88 is positioned generally within a recess 92 defined by the closure base 30, within which recess the indicator portion 88 moves as the sliding element 36 is moved from its latched position to its unlatched position. Attendant to closing movement of the lid, link 34B acts against pusher portion 84 to move the sliding element 36 from its unlatched position toward its latched position. Cam surface 94 of the sliding element coacts with the closure base 30 to facilitate movement of the indicator portion 88 out of the recess 92. The closure system is thus configured such that the sliding element 36 is not returned to its latched position until the lid 32 is substantially closed, again, with the closing movement of the lid acting to return the sliding element to its latched position. With the lid in its substantially fully closed position, and with a spud 64 again sealing positioned within dispensing orifice 50, latch portion 78 of the sliding element is positioned for cooperative engagement and retention of lid latch portion 80, thus desirably retaining the lid 32 in its closed position.

Figure 17:
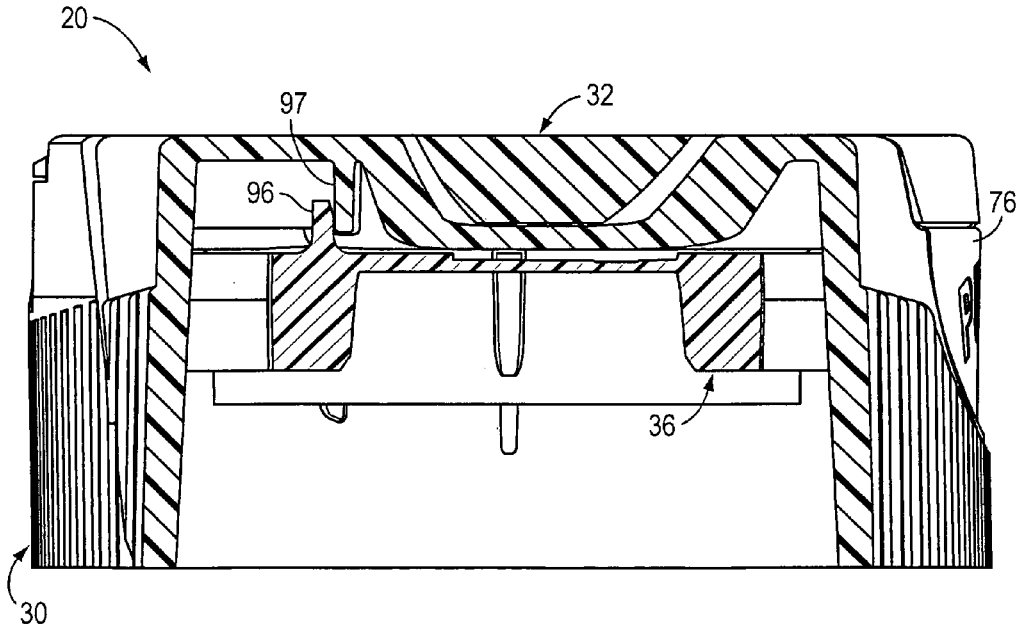
FIG. 17 is a greatly enlarged, cross-sectional view taken generally along the plane 17-17 in FIG. 16.

In the preferred embodiment, the sliding element 36 includes at least one upstanding stop element 96 which cooperates with the closure base 30 at 97 (see FIG. 17) to limit return travel of the sliding element to its latched position. The illustrated embodiment includes a pair of step elements 96 respectively provided on the side portions 72 of sliding element 36. Thus, lateral sliding movement of the sliding element relative to closure base 30 is limited and defined by stop surface 86, which limits rearward or opening travel of the sliding element, and upstanding stop elements 96, which limit return movement of the sliding element into its latched position.

As noted, sliding element 36 is configured for snap-fitment within the closure base 30. This is effected by positioning the sliding element 36 generally beneath the closure base, between skirt 42 and internal collar 44. To effect assembly of the sliding element into the closure base, the pusher portion 84 can be inserted generally through a rearward portion of the closure base, to a position for engagement with link 34B, and thereafter the sliding element is pivoted or rotated generally upwardly about the pusher portion, so that button portion 76 snap fits generally into the closure base beneath recessed deck 40. Button portion 76 is thus presented at a forward portion of the closure assembly for manipulation, with the pusher portion 84 thus being positioned for coaction with link 34B.

Operation of the present dispensing closure system from the above description will be readily apparent. Assembly of the present system is effected by disposition of sliding element 36 generally within closure base 30, after which lid 32 may be moved to its closed position in which it is retained by cooperation of latch portion 78 of sliding element 36 with lid latch portion 80. Disposition of spud 64 within dispensing orifice 50 provides the desired sealing of the dispensing orifice. In this configuration, the closure system 20 can be fitted to an associated container by threaded engagement of inwardly projecting thread 46 with male thread 29 of an associated container after the desired contents have been placed therein. Filled containers can thereafter be stored and shipped, as desired, with cooperation of the latch portion of the sliding element desirably acting to maintain the lid 32 in a closed disposition during storage and shipment of the container.

For dispensing the contents of the container, a user need merely grip the container and manipulate button portion 76 of sliding element 36. By this action, the sliding element is moved generally laterally and rearwardly of closure base 30, thereby disengaging latch portion 78 on the sliding element from the lid latch portion 80. In conjunction with sliding movement of the sliding element 36, camming surfaces 82 at button portion 76 act to urge the lid upwardly and disengage spud 64 from dispensing orifice 50, with the camming surface at pusher portion 84 engaging and coacting with link 34B of the lid 32 to urge the lid from its closed position to its open position. During movement of the sliding element 36 in this fashion, sufficient movement of the link 34B of lid 32 acts to move the link to its over-center orientation, whereby the lid 32 springs open under the action of the link 34B. The lid 32 is conveniently retained in its open position as the contents of the associated container are dispensed through the dispensing orifice.

Attendant to sliding movement of the sliding element 36, interengagement of indicator portion 88 with surface 90 of the closure base 30 provides the desired audible indication that the lid has been unlatched, and is moving to its open position. Stop surface 86 cooperates with the closure base to limit the movement of sliding element 36 from its latched position to its unlatched position.

When dispensing of the contents of the container is completed, convenient manipulation of lid 32 from its open position to its closed position acts against pusher portion 84 to return sliding element 36 to its latched position. Indicator portion 88 is moved from within recess 92, with such movement facilitated by the provision of cam surface 94, with the arrangement configured such that sliding element 36 does not fully move to its latched position until the lid 32 is substantially closed. As sliding element 36 fully returns to its latched position, latch portion 78 is again positioned for engagement, and retention of lid latch portion 80, thus desirably retaining the lid 32 in its closed position. Upstanding stop elements 96 cooperate with the closure base to limit movement of the sliding element 36 as it is returned to its latched position.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing closure system for a container that has an opening to the container interior where a fluent substance may be stored, said dispensing closure system comprising:

a closure base for extending from said container at said container opening, said closure base having (1) a dispensing orifice for communicating with the container interior, (2) a deck that defines said dispensing orifice, and (3) a skirt depending from said deck;

a lid for moving between: (1) a closed position on top of said base to occlude said dispensing orifice, and (2) an open position away from said dispensing orifice to permit the dispensing of a substance from said container;

a hinge connecting said lid with said closure base; and a sliding element mounted on said closure base for generally lateral movement with respect thereto from a latched position to an unlatched position, said sliding element including a latch portion engageable with said lid when said lid is in said closed position and said sliding element is in said latched position, said sliding element being movable generally laterally of said closure base from said latched position to disengage said latch portion from said lid, to permit movement of said lid from said closed position to said open position, and to thereby permit dispensing of the fluent substance within said container through said dispensing orifice, said sliding element including at least one camming surface engageable with said lid in the closed position thereof when said sliding element is in said latched position, so that lateral movement of said sliding element relative to said closure base from said latched position causes said camming surface to urge said lid out of said closed position toward said open position, wherein said dispensing orifice is positioned intermediate said hinge and said latch portion of said sliding element, wherein:

said sliding element is mounted on said closure base generally beneath said deck thereof, said closure base having a hollow, generally cylindrical, internal collar depending from said deck, said internal collar including an internal, female thread for threadingly engaging a male thread on said container, said sliding element having a generally ring-shaped configuration, and being positioned generally beneath said deck between said internal collar and said skirt of said closure base.

2. The closure system in accordance with claim 1 for use with a container that has an annular top end defining (1) an opening, and (2) an external, male thread around said opening, and in which said closure system is a dispensing closure that is separate from, but releasably attachable to, said container around said container opening; and said dispensing closure includes a spout that extends outwardly from said deck to define said dispensing orifice.

3. The closure system in accordance with claim 1, wherein:

said sliding element includes a button portion configured for manipulation to move said sliding element laterally of said closure base from said latched positioned to said unlatched position.

4. The closure system in accordance with claim 3, wherein:

said button portion defines said camming surface of said sliding element.

5. The closure system in accordance with claim 1, wherein:

sliding element includes a button portion configured for manipulation to move said sliding element laterally of said closure base from said latched position to said unlatched position, and a distal pusher portion, positioned distally of said button portion, and defining said camming surface for engagement with said lid so that lateral movement of said sliding element from said latched position to said unlatched position moves said pusher portion into engagement with said lid to urge said lid toward said open position.

6. The closure system in accordance with claim 1, wherein:

said sliding element includes an indicator portion engageable with said closure base as said sliding element is moved laterally of said closure base from said latched position to said unlatched position, to provide an audible indication that said latch portion of said sliding element has been disengaged from said lid.

7. The closure system in accordance with claim 1, wherein:

said sliding element defines a stop surface engageable with said closure base as said sliding element is moved laterally of said closure base into said unlatched position to limit the lateral movement of said sliding element.

8. A dispensing closure system for a container within which a fluent substance may be stored, said container having an annular top end defining (1) an opening, and (2) an external, male thread around said opening, said closure system being releasably attachable to said container around said container opening, said dispensing closure system comprising:

a closure base for extending from said container at said container opening, said closure base having (1) a dispensing orifice for communicating with the container interior, (2) a deck that defines said dispensing orifice, (3) a skirt depending from said deck, and (4) a generally cylindrical, internal collar depending from said deck inwardly of said skirt, said internal collar including an internal, female thread for threadingly engaging said male thread on said container;

a lid for moving between: (1) a closed position on top of said base to occlude said dispensing orifice, and (2) an open position away from said dispensing orifice to permit the dispensing of a substance from said container;

a hinge connecting said lid with said closure base; and a sliding element having a generally ring-shaped configuration mounted on said closure base, generally beneath said deck between said skirt and said internal collar, for generally lateral movement with respect thereto from a latched position to an unlatched position, said sliding element including a latch portion engageable with said lid when said lid is in said closed position and said sliding element is in said latched position, said sliding element being movable generally laterally of said closure base from said latched position to disengage said latch portion from said lid, to permit movement of said lid from said closed position to said open position, and to thereby permit dispensing of the fluent substance within said container through said dispensing orifice, said sliding element including at least one camming surface engageable with said lid in the closed position thereof when said sliding element is in said latched position, so that lateral movement of said sliding element relative to said closure base from said latched position causes said camming surface to urge said lid out of said closed position toward said open position, said sliding element including an indicator portion engageable with said closure base as said sliding element is moved laterally of said closure base from said latched position to said unlatched position, to provide an audible indication that said latch portion of said sliding element has been disengaged from said lid, wherein said dispensing orifice is positioned intermediate said hinge and said latch portion of said sliding element.

9. The closure system in accordance with claim 8, wherein:

said sliding element includes a button portion configured for manipulation to move said sliding portion laterally of said closure base from said latched positioned to said unlatched position, said button portion defining said camming surface of said sliding element.

10. The closure system in accordance with claim 9, wherein:

sliding element includes a distal pusher portion, positioned distally of said button portion, and defining another camming surface for engagement with said lid so that lateral movement of said sliding element from said latched position to said unlatched position moves said pusher portion into engagement with said lid to urge said lid toward said open position.

11. The closure system in accordance with claim 8, wherein:

said sliding element defines a stop surface engageable with said closure base as said sliding element is moved laterally of said closure base into said unlatched position to limit the lateral movement of said sliding element.

12. A dispensing closure system for a container that has an opening to the container interior where a fluent substance may be stored, said dispensing closure system comprising:

a closure base for extending from said container at said container opening, said closure base having (1) a dispensing orifice for communicating with the container interior, (2) a deck that defines said dispensing orifice, and (3) a skirt depending from said deck;

a lid for moving between: (1) a closed position on top of said base to occlude said dispensing orifice, and (2) an open position away from said dispensing orifice to permit the dispensing of a substance from said container;

a hinge connecting said lid with said closure base; and a sliding element mounted on said closure base for generally lateral movement with respect thereto from a latched position to an unlatched position, said sliding element including a latch portion engageable with said lid when said lid is in said closed position and said sliding element is in said latched position, said sliding element being movable generally laterally of said closure base from said latched position to disengage said latch portion from said lid, to permit movement of said lid from said closed position to said open position, and to thereby permit dispensing of the fluent substance within said container through said dispensing orifice, said sliding element including at least one camming surface engageable with said lid in the closed position thereof when said sliding element is in said latched position, so that lateral movement of said sliding element relative to said closure base from said latched position causes said camming surface to urge said lid out of said closed position toward said open position, wherein said dispensing orifice is positioned intermediate said hinge and said latch portion of said sliding element, said sliding element including a button portion configured for manipulation to move said sliding element laterally of said closure base from said latched positioned to said unlatched position, said button portion defining said camming surface of said sliding element.

* * * * *